US007742003B2

(12) United States Patent
Tseng et al.

(10) Patent No.: US 7,742,003 B2
(45) Date of Patent: Jun. 22, 2010

(54) BROADBAND ANTENNA AND AN ELECTRONIC DEVICE THEREOF

(75) Inventors: Kuan-Hsueh Tseng, Taipei Hsien (TW); Yi-Ling Chiu, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 203 days.

(21) Appl. No.: 12/219,086

(22) Filed: Jul. 16, 2008

(65) Prior Publication Data

US 2009/0046016 A1 Feb. 19, 2009

(30) Foreign Application Priority Data

Aug. 14, 2007 (TW) ..... 96213418 U
Jun. 13, 2008 (TW) ..... 97210544 U

(51) Int. Cl.
*H01Q 1/24* (2006.01)

(52) U.S. Cl. ..... 343/702; 343/700 MS

(58) Field of Classification Search ..... 343/702, 343/700 MS, 846
See application file for complete search history.

(56) References Cited

U.S. PATENT DOCUMENTS 6,100,850 A 8/2000 Utsumi
6,861,986 B2 3/2005 Fang et al.
7,170,464 B2 * 1/2007 Tang et al. ..... 343/830
7,649,501 B2 * 1/2010 Wong et al. ..... 343/702
2005/0128151 A1 6/2005 Kwak et al.

FOREIGN PATENT DOCUMENTS

EP 1 162 688 A1 12/2001
WO WO 02/29988 A1 4/2002

* cited by examiner

*Primary Examiner*—Hoang V Nguyen
(74) *Attorney, Agent, or Firm*—Bacon & Thomas, PLLC

(57) ABSTRACT

A broadband antenna for wireless signal transmission of an electronic device is disclosed. The broadband antenna has a radiating element, a grounding element, a short-circuiting element and a feeding plane. The radiating element has a first radiation area and a second radiation area, the first radiation area and the second radiation area perpendicularly connected to each other substantially. The feeding plane perpendicularly connected to the second radiation area substantially, the feeding plane comprising a feeding point, a first end and a second end; wherein a distance between the feeding point and the first end is less than a distance between the feeding point and the second end. The short-circuiting element is used for connecting the first radiation area with the grounding element or connecting the feeding plane with the grounding element.

20 Claims, 27 Drawing Sheets

BROADBAND ANTENNA AND AN ELECTRONIC DEVICE THEREOF

BACKGROUND OF THE INVENTION

1. Field of the Invention

The present invention relates to an antenna and, more particularly, to a broadband antenna with a feeding plane.

2. Description of the Related Art

With developments in wireless communications technologies, many electronic devices, such as notebooks and mobile phones, now include wireless communications capabilities. Moreover, with improvements in the integration of wireless communication systems, broadband antennas have become increasingly important. In order to permit a wireless communication device to utilize various frequency bandwidths, antennas having wider bandwidths have become the most significant technology certainly.

However, in wireless communications, the Wireless Wide Area Network (WWAN) antenna and Wireless Fi-delity (Wi-Fi) antenna are very popular and significant transmission devices. In prior art technologies, the working frequency range of a WWAN antenna is usually 824~960 MHz and 1710~2170 MHz, and the working frequency range of a Wi-Fi antenna is usually 2.4~2.5 GHz and 5.15~5.85 GHz. However, these bandwidths of the antenna do not satisfy current needs. New antennas should be able to have wider bandwidths; for example, to satisfy global positioning system (GPS) frequencies of 1575 MHz and digital video broadcasting-handheld (DVB-H) frequencies 1627 MHz.

In order to satisfy different transmission frequency ranges, the prior art technology discloses an antenna for these portable electronic devices. Please refer to FIG. 1A. FIG. 1A is a schematic drawing of a prior art antenna 90 disclosed in U.S. Pat. No. 6,861,986. The prior art antenna 90 has a radiating element 91, a connecting element 92 and a grounding element 93. The connecting element 92 has a first end 921 and a second end 922; the first end 921 of the connecting element 92 is connected to the radiating element 91; and the second end 922 is connected to the grounding element 93.

Please refer to FIG. 1B. FIG. 1B shows the VSWR at different frequencies according to the prior art antenna 90 shown in FIG. 1A. As shown in FIG. 1B, the working frequency range is only 2.5 GHz and 5 GHz approximately. Therefore, the antenna 90 only satisfies current bandwidth requirements of the Wi-Fi antenna but does not satisfy current bandwidth requirements of the WWAN antenna or other broadband antennas.

Therefore, it is desirable to provide a broadband antenna to mitigate and/or obviate the aforementioned problems.

SUMMARY OF THE INVENTION

A main objective of the present invention is to provide a broadband antenna.

Another objective of the present invention is to provide an electronic device having the broadband antenna.

In order to achieve the above mentioned objective, the electronic device of the present invention comprises a broadband antenna and a wireless transmission module. The broadband antenna electrically connects to the wireless transmission module. A first embodiment of the broadband antenna of the present invention comprises: a radiating element, a grounding element, a short-circuiting element and a feeding plane. The radiating element has a first radiation area and a second radiation area, the first radiation area and the second radiation area are perpendicularly connected to each other substantially. The short-circuiting element is used for connecting the first radiation area with the grounding element. The feeding plane is perpendicularly connected to the second radiation area substantially. The feeding plane has a feeding point, a first end and a second end. The feeding point is electrically connected to a feeding line and used for transmitting electrical signals. A distance between the feeding point and the first end is less than a distance between the feeding point and the second end. A distance between the short-circuiting element and the second end is less than a distance between the short-circuiting element and the first end, and a distance between the short-circuiting element and the second end is less than or equal to a distance between the short-circuiting element and the feeding point.

In another embodiment, the radiating element of the broadband antenna further comprises a third radiation area.

In another embodiment, the grounding element of the broadband antenna further comprises a parasitic element. The parasitic element and the third radiation area are disposed oriented in the same direction or in opposite directions.

In another embodiment, the radiating element of the broadband antenna further comprises a fourth radiation area.

In another embodiment, the short-circuiting element is used for connecting the feeding plane with the grounding element.

Therefore, the broadband antenna is capable of a wider bandwidth signal transmission.

Other objects, advantages, and novel features of the invention will become more apparent from the following detailed description when taken in conjunction with the accompanying drawings.

DETAILED DESCRIPTION OF THE PREFERRED EMBODIMENT

Figure 2A:
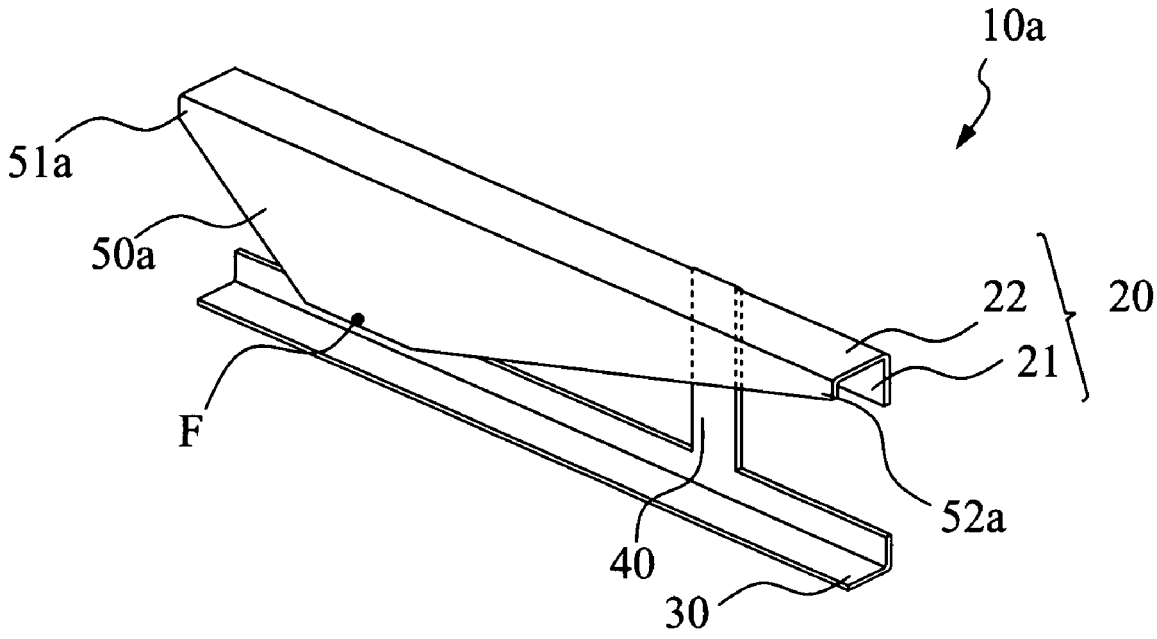
FIG. 2A is a perspective drawing of a broadband antenna according to a first embodiment of the present invention.

Please refer to FIG. 2A. FIG. 2A is a perspective drawing of a broadband antenna according to a first embodiment of the present invention.

A first embodiment broadband antenna 10*a* is a shorted monopole antenna. The broadband antenna 10*a* comprises a radiating element 20, a grounding element 30, a short-circuiting element 40 and a feeding plane 50*a*. The radiating element 20 comprises a first radiation area 21 and a second radiation area 22, which are used for transmitting wireless communication signals. The first radiation area 21 and the second radiation area 22 are substantially perpendicularly connected to each other. The grounding element 30 is used for grounding the broadband antenna 10*a*. The short-circuiting element 40 is connected to both the first radiation area 21 of radiating element 20 and the grounding element 30 to provide the broadband antenna 10*a* better resonance effects. The feeding plane 50*a* is a wide plane, and is substantially perpendicularly connected to the second radiation area 22. The feeding plane 50*a* has a feeding point F, a first end 51*a* and a second end 52*a*. The first end 51*a* and the second end 52*a* are located along an intersection of the feeding plane 50*a* and the second radiation area 22. The feeding point F is located at the edge of the feeding plane 50*a*. The feeding point F and a feeding line (not shown) are electrically connected to each other and used for transmitting an electrical signal. The feeding line can be an RF cable or other transmission line types. When the electrical signal is transmitted to the feeding plane 50*a*, with the wide feeding plane 50*a* the electrical signal has a wider current transmission path.

In this embodiment, the edge of the feeding plane 50*a* of the broadband antenna 10*a* is a substantially straight linear edge. In the present invention, the feeding plane 50*a* of the broadband antenna 10*a* has limited shapes. The ratio of the distance between the first end 51*a* and the feeding point F, and the distance between the second end 52*a* and the feeding point F is 1:2 or 1:3; however, the present invention does not limited to these ratios exactly. In the present invention, the distance between the first end 51*a* and the feeding point F is less than the distance between the second end 52*a* and the feeding point F. Also, the distance between the second end 52*a* and the short-circuiting element 40 is less than the distance between the first end 51*a* and the short-circuiting element 40. The broadband antenna 10*a* is in this manner provided a broader high frequency bandwidth.

Figure 1A:
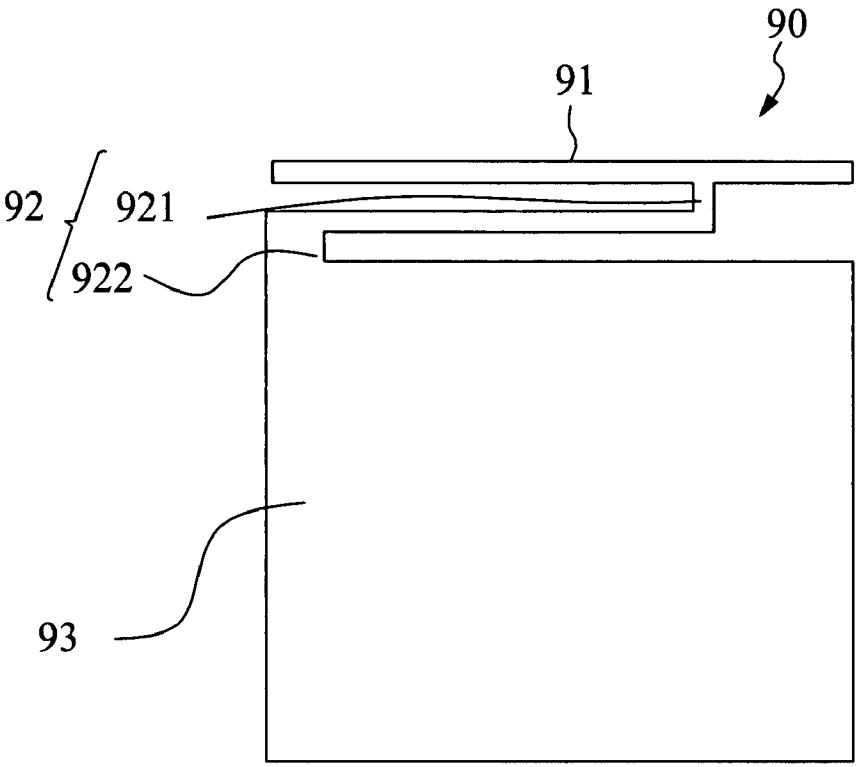
Prior Art FIG. 1A
FIG. 1A is a schematic drawing of a prior art antenna.
Figure 1B:
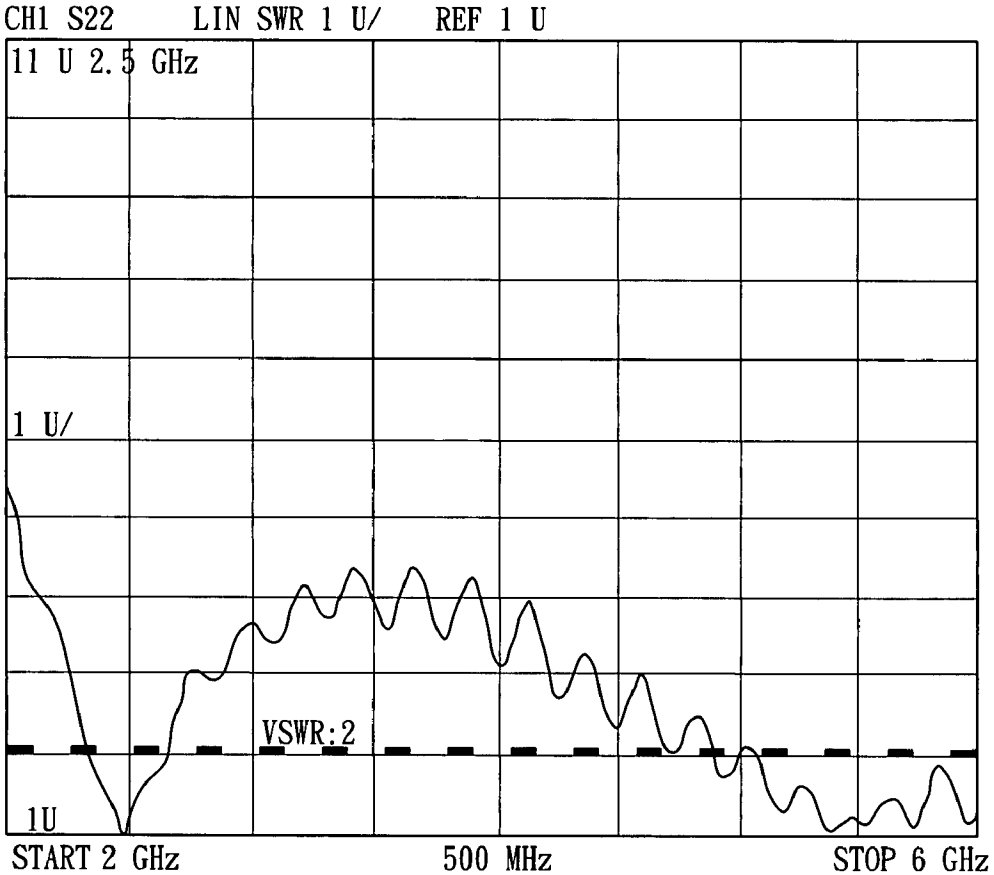
Prior Art FIG. 1B
FIG. 1B shows the VSWR at different frequencies according to the prior art antenna shown in FIG. 1A.
Figure 2B:
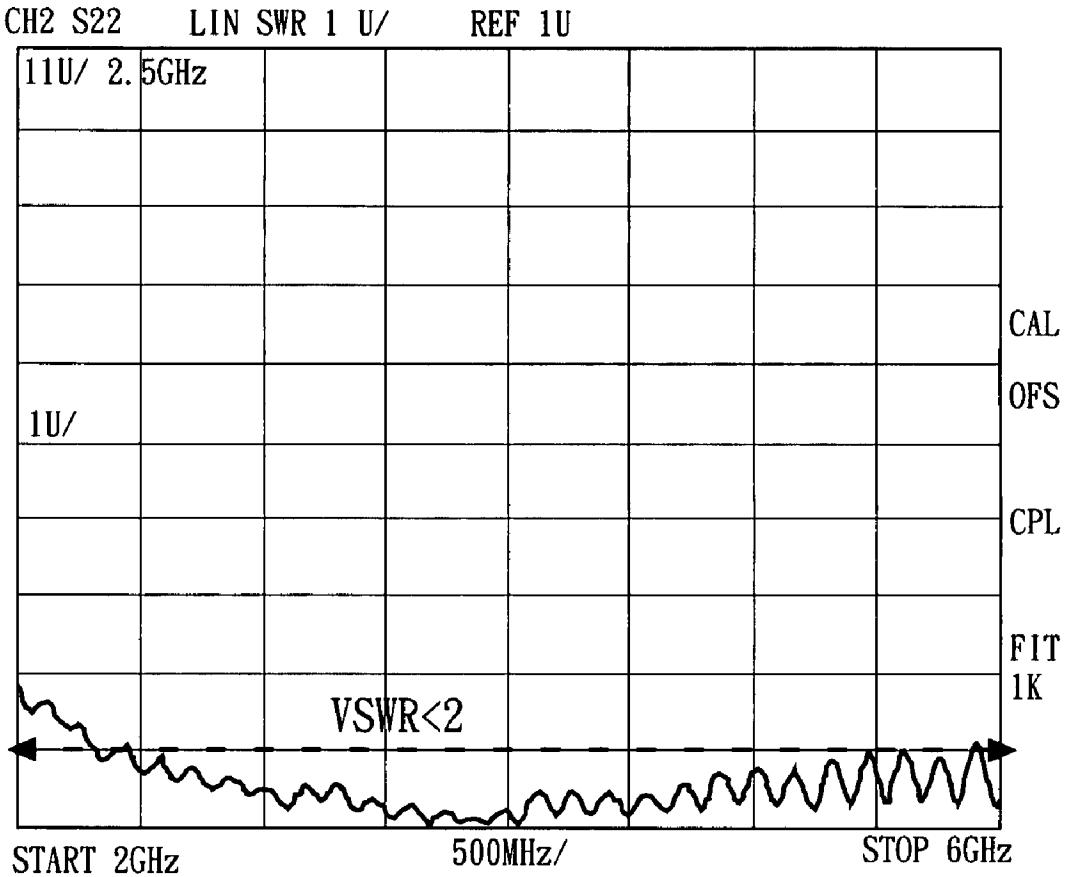
FIG. 2B shows the VSWR at different frequencies according to FIG. 2A.

FIG. 2B shows the VSWR at different frequencies according to FIG. 2A. As shown in FIG. 2B, from frequencies of 2.3 GHz to 5.9 GHz, the VSWR values of the broadband antenna 10*a* are all under 2. Therefore, the broadband antenna 10*a* is capable of transmitting signals with frequencies from 2.3 GHz to 5.9 GHz. In comparison with the prior art antenna 90 shown in FIG. 1A, the broadband antenna 10*a* has a broader bandwidth.

Figure 2C:
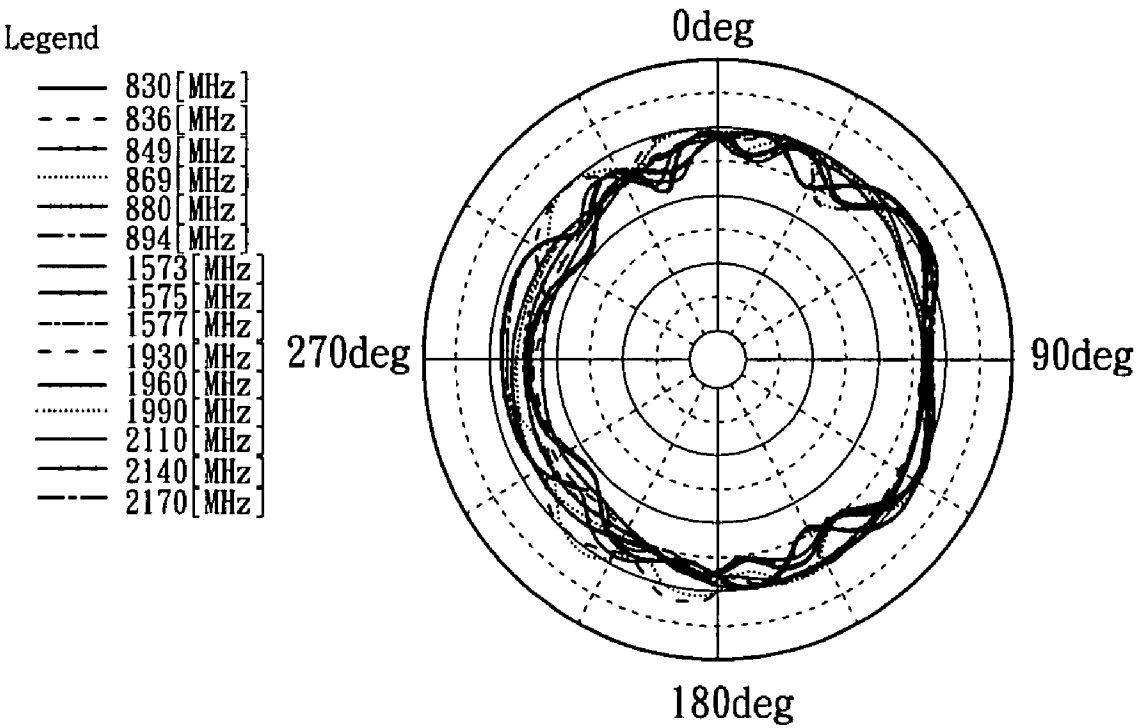
FIG. 2C shows a broadband antenna of FIG. 2A on a horizontal plane.

FIG. 2C shows a broadband antenna of FIG. 2A on a horizontal plane. As shown in FIG. 2C, the broadband antenna 10*a* is an omni-directional antenna.

Figure 3A:
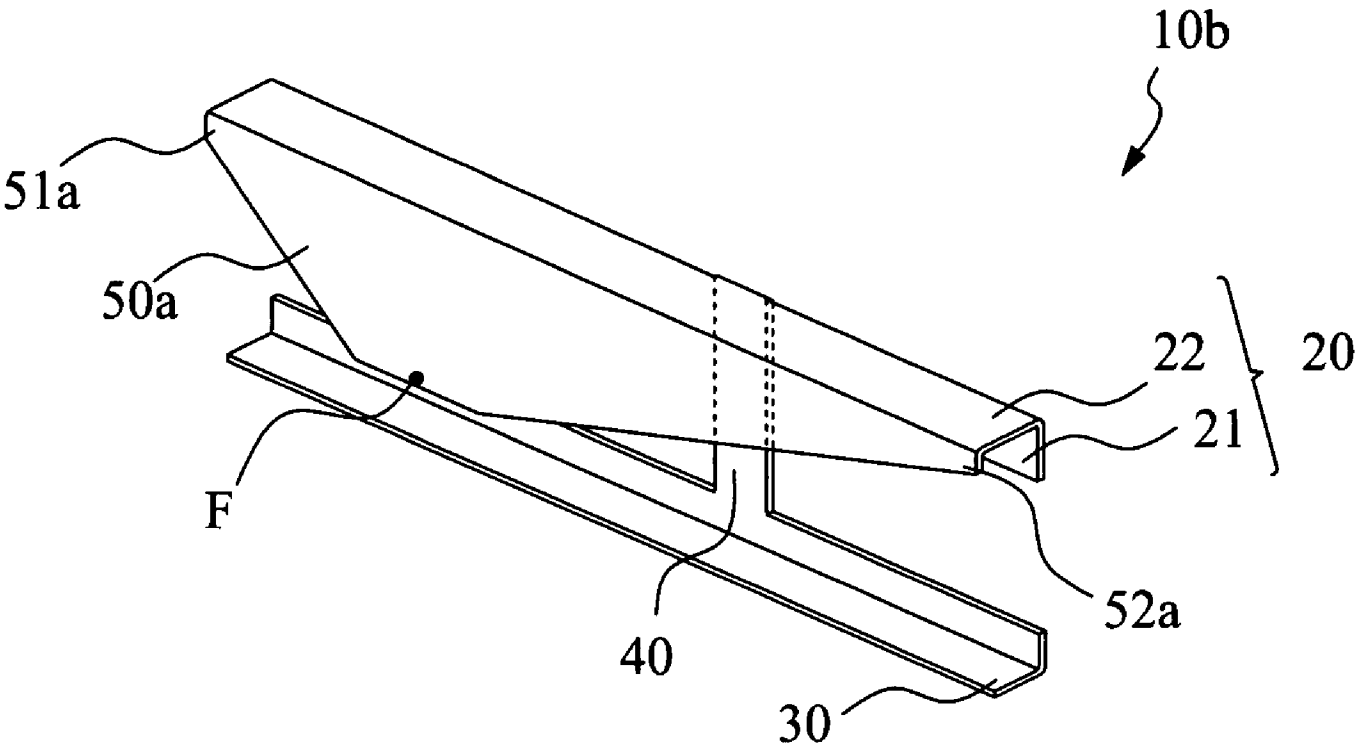
FIG. 3A is a perspective drawing of a broadband antenna according to a second embodiment of the present invention.
Figure 3B:
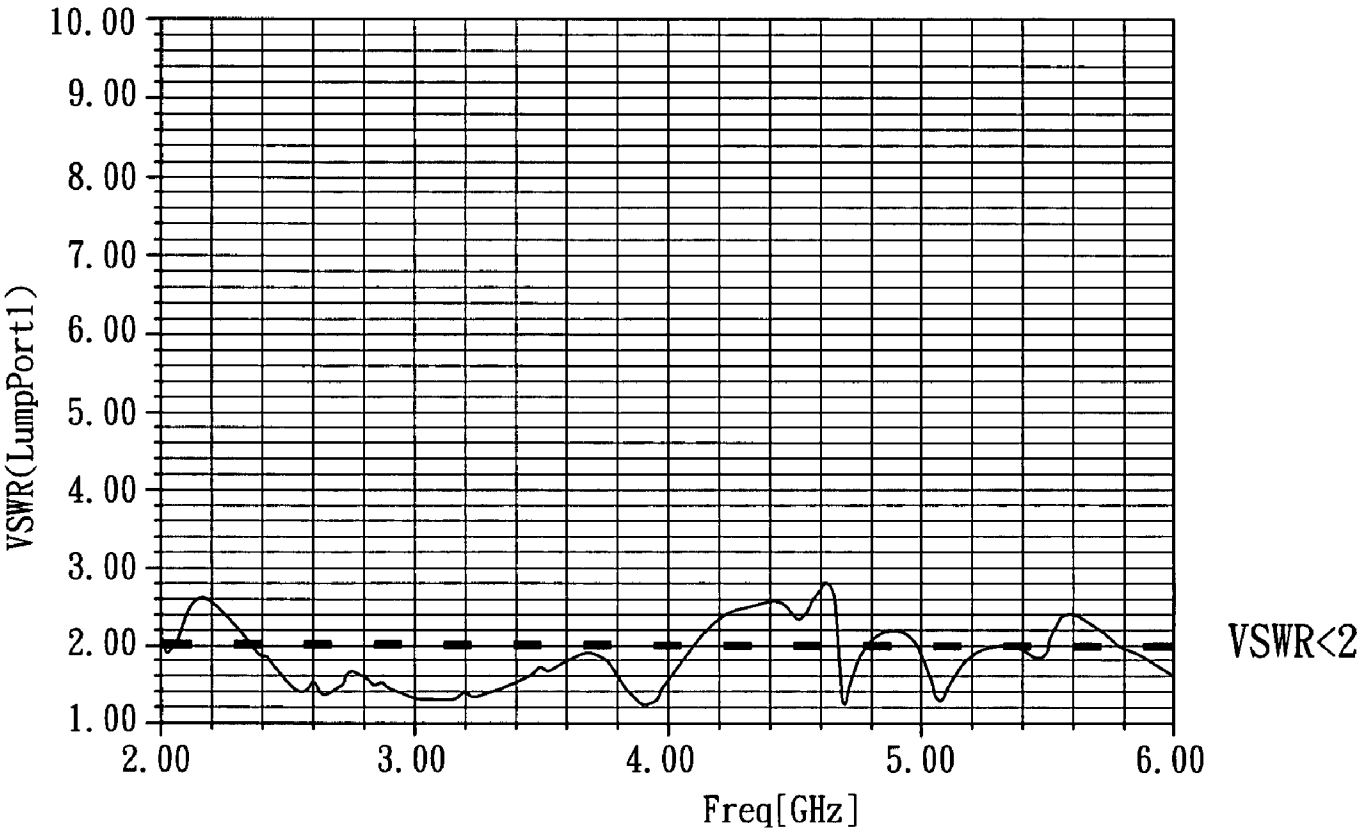
FIG. 3B shows the VSWR at different frequencies according to FIG. 3A.

Please refer to FIG. 3A. FIG. 3A is a perspective drawing of a broadband antenna according to a second embodiment of the present invention. The short-circuiting element 40 of a broadband antenna 10*b* is located at about a middle point between the second end 52*a* and the feeding point F. In comparison with the broadband antenna 10*a*, the short-circuiting element 40 of the broadband antenna 10*b* is located closer to the feeding point F. Please refer to FIG. 3B. FIG. 3B shows the VSWR at different frequencies according to FIG. 3A. The broadband antenna 10*b* also has broadband transmission capabilities. Therefore, the distance between the short-circuiting element 40 and the second end 52*a* may be less than or equal to the distance between the short-circuiting element 40 and feeding point F.

Figure 4A:
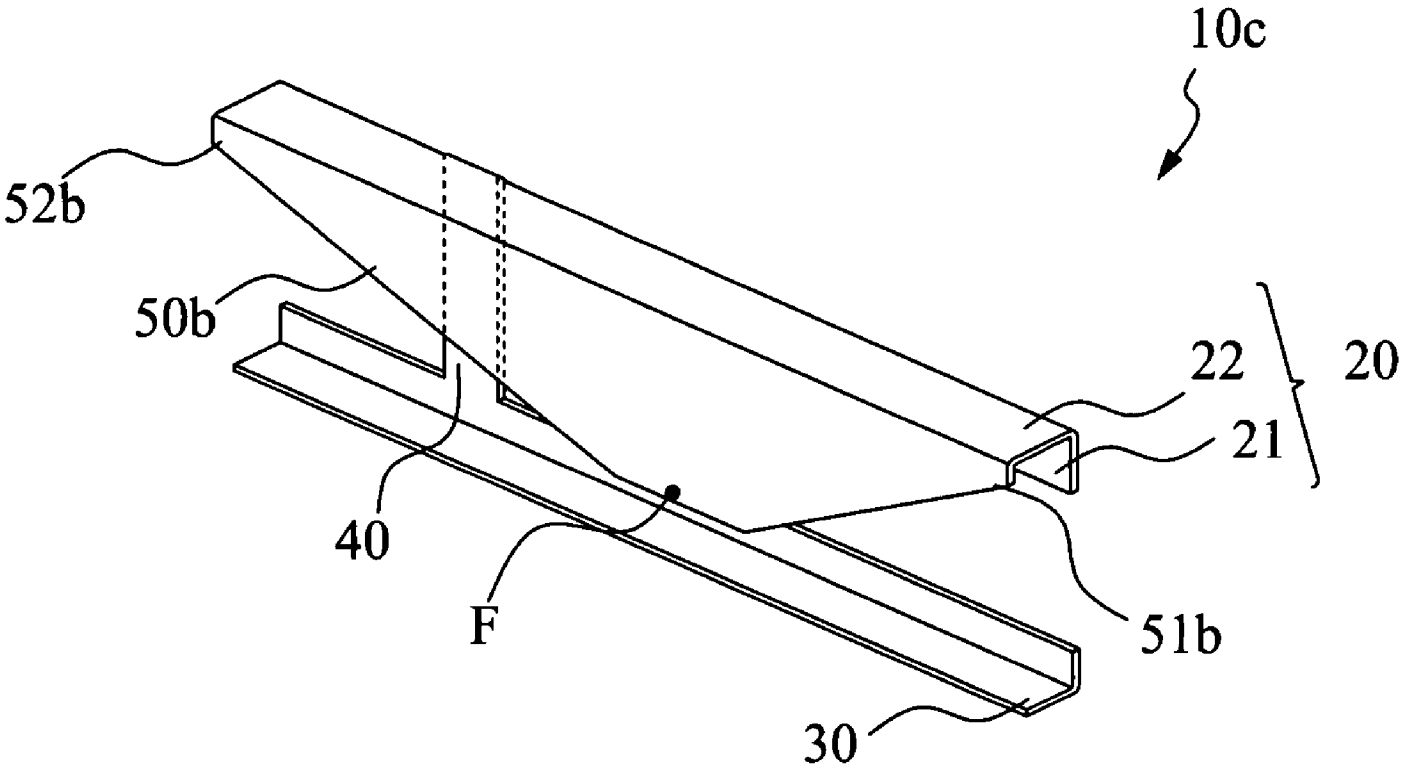
FIG. 4A is a perspective drawing of a broadband antenna according to a third embodiment of the present invention.
Figure 4B:
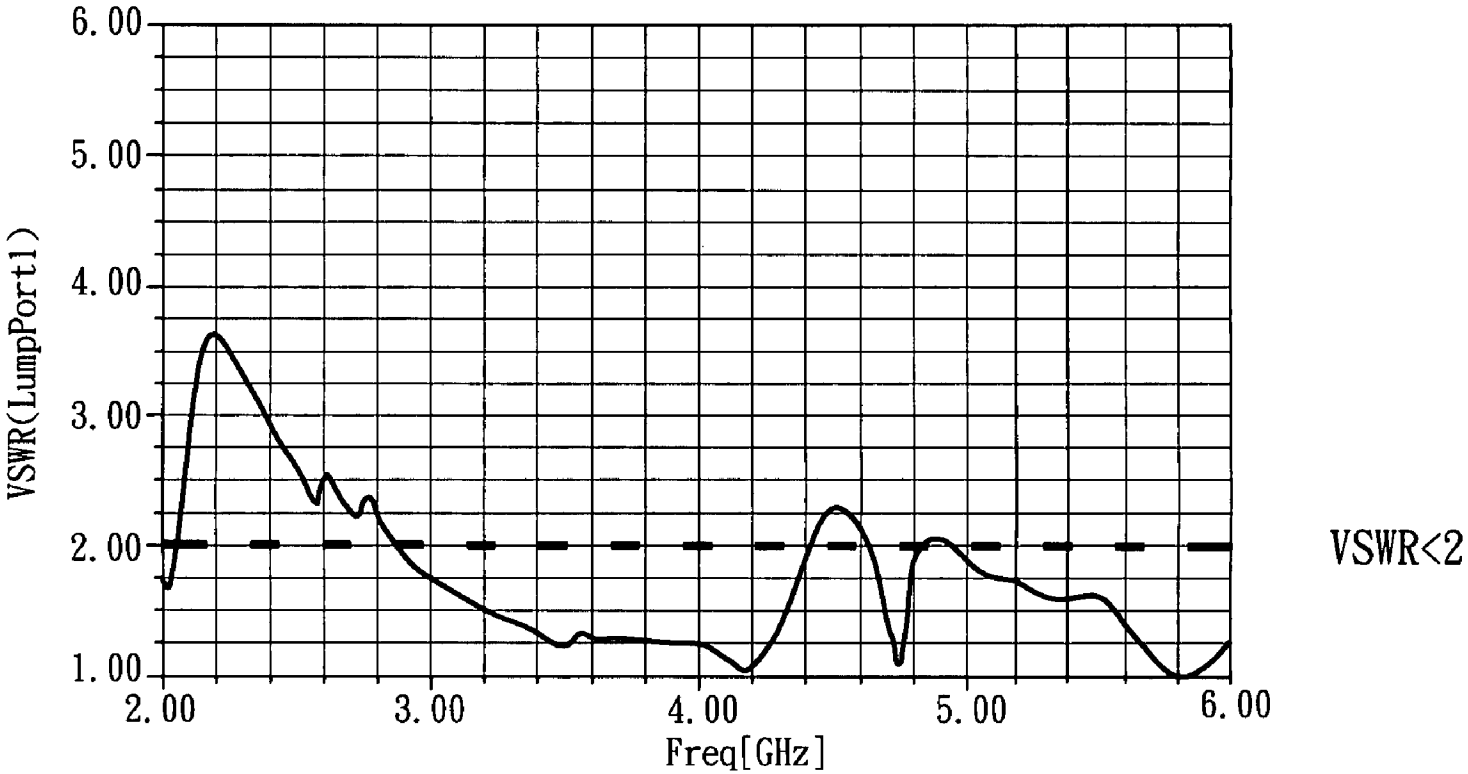
FIG. 4B shows the VSWR at different frequencies according to FIG. 4A.

Please refer to FIG. 4A and FIG. 4B. FIG. 4A is a perspective drawing of a broadband antenna according to a third embodiment of the present invention. FIG. 4B shows the VSWR at different frequencies according to FIG. 4A. A broadband antenna 10*c* is an inversion of the broadband antenna 10*a*, meaning that the feeding plane 50*b* has a shape opposite to that of the feeding plane 50*a* of the broadband antenna 10*a*. Moreover, the distance between the second end 52*b* and the short-circuiting element 40 is less than the distance between the first end 51*b* and the short-circuiting element 40, and the distance between the short-circuiting element 40 and the second end 52*b* is also less than or equal to the distance between the short-circuiting element 40 and the feeding point F. The broadband antenna 10*c* also has broadband transmission capabilities.

Figure 5A:
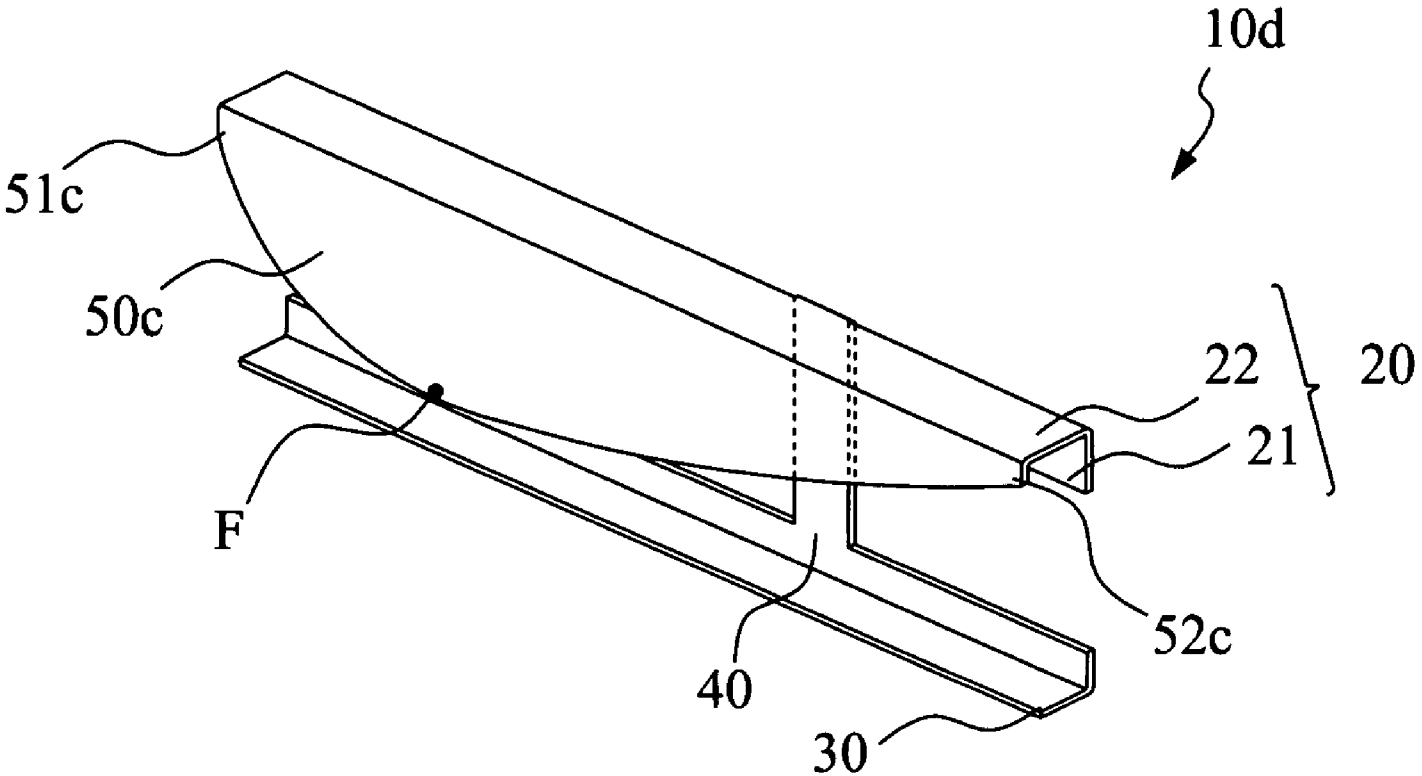
FIG. 5A is a perspective view of a broadband antenna according to a fourth embodiment of the present invention.

The edge of the feeding plane 50*a* of the present invention may have other shapes, such as a straight line or a curved line shown in FIG. 5A beyond simply the trapezoid shown in FIG. 2A. Please refer to FIG. 5A. FIG. 5A is a perspective view of a broadband antenna according to a fourth embodiment of the present invention. As shown in FIG. 5A, the edge of the feeding plane 50*c* of a broadband antenna 10*d* has a substantially curved edge. The distances from the feeding point F of the broadband antenna 10*d* to the first end 51*c* and the second end 52*c* have the same characteristics. The distance between the first end 51*c* and the feeding point F is less than the distance between the second end 52*c* and the feeding point F. Similarly, the distance between the second end 52*c* and the short-circuiting element 40 is less than the distance between the first end 51*c* and the short-circuiting element 40, and the distance between the short-circuiting element 40 and the second end 52*c* is also less than or equal to the distance between the short-circuiting element 40 and the feeding point F.

Figure 5B:
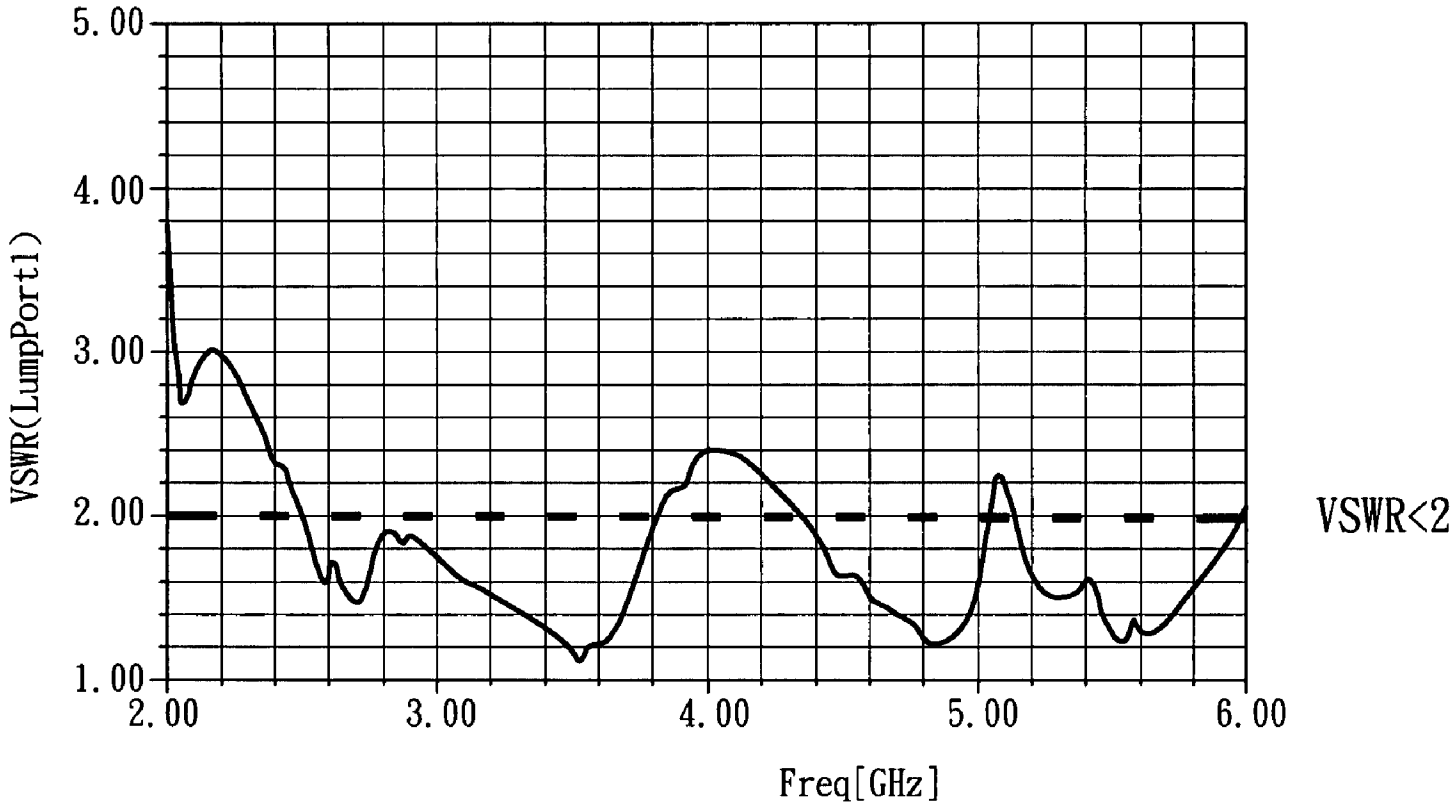
FIG. 5B shows the VSWR at different frequencies according to FIG. 5A.

Please refer to FIG. 5B. FIG. 5B shows the VSWR at different frequencies according to FIG. 5A. The feeding plane 50*c* having a curved edge shown in FIG. 5B may be used in the broadband antenna 10*d*, which also has broadband transmission capabilities.

Figure 6A:
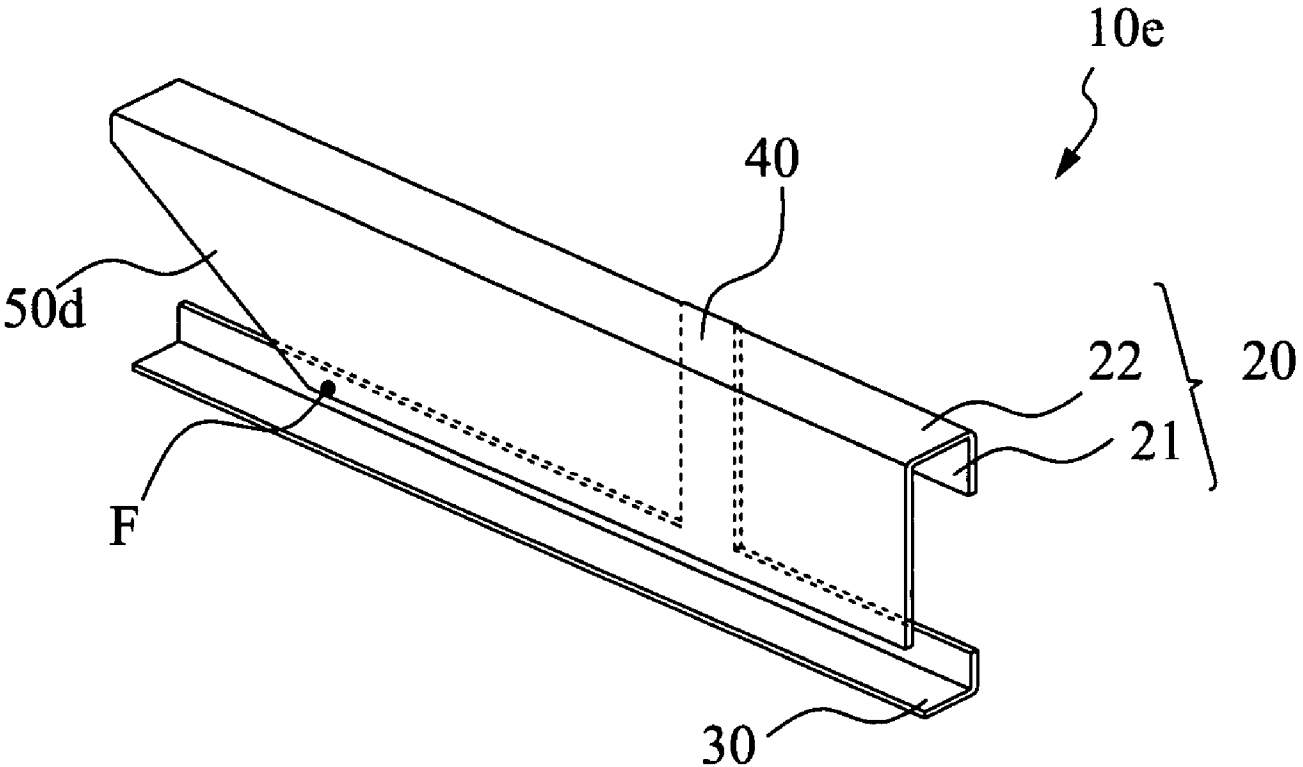
FIG. 6A is a perspective view of a broadband antenna according to a fifth embodiment of the present invention.
Figure 6B:
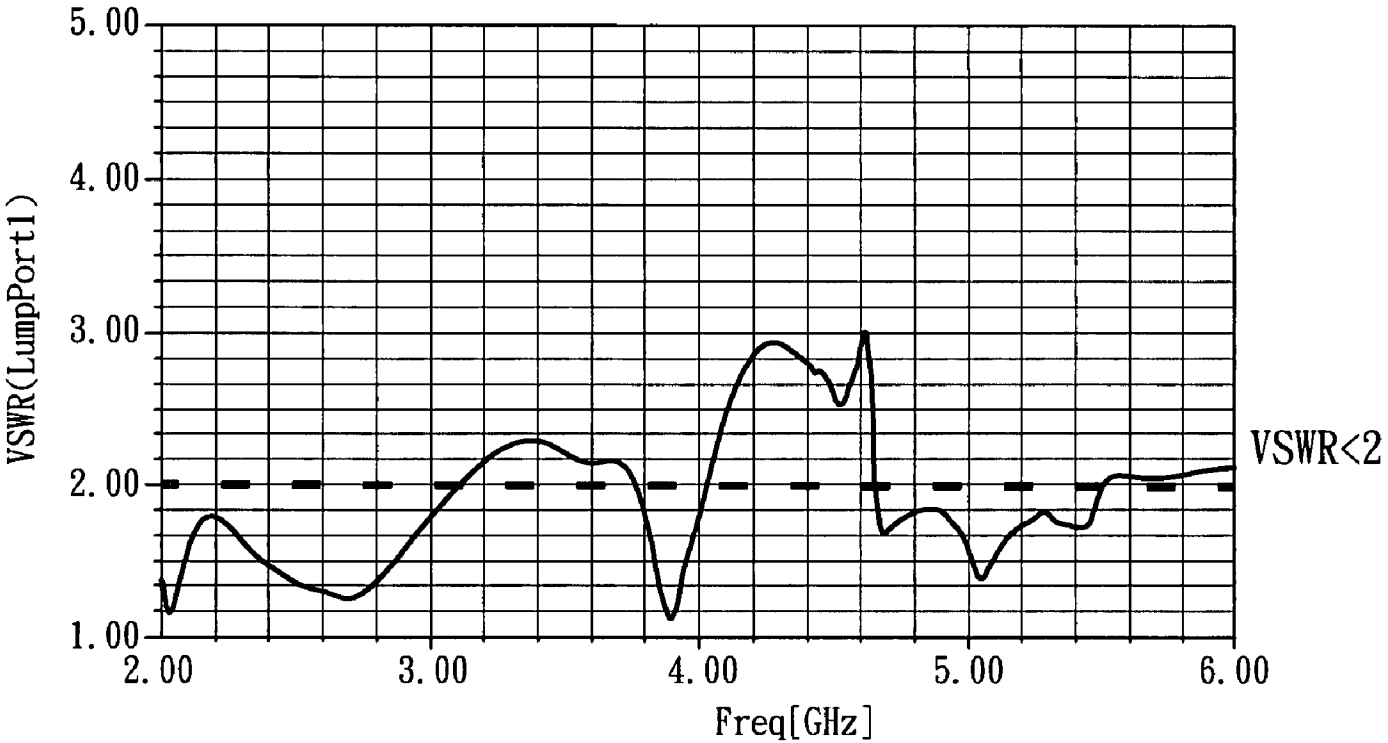
FIG. 6B shows the VSWR at different frequencies according to FIG. 6A.

The feeding plane may also have a shape as shown in FIG. 6A. FIG. 6A is a perspective view of a broadband antenna according to a fifth embodiment of the present invention. A broadband antenna 10*e* has a feeding plane 50*d*. One side of the feeding plane 50*d* is a bevel short side and the other side is a perpendicular side. FIG. 6B shows the VSWR at different frequencies according to FIG. 6A. As shown in FIG. 6B, a working frequency range of the broadband antenna 10*e* also conforms to the requirements of the present invention.

Figure 7A:
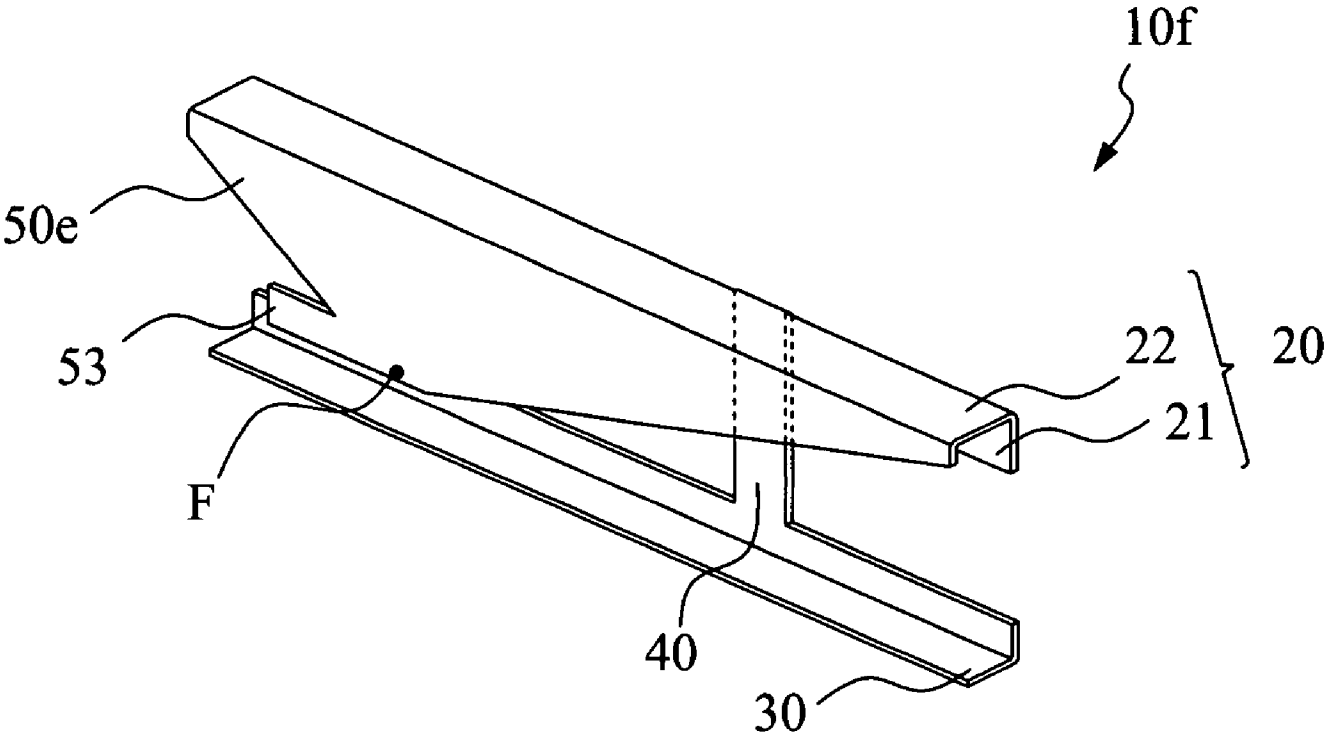
FIG. 7A is a perspective view of a broadband antenna according to a sixth embodiment of the present invention.
Figure 7B:
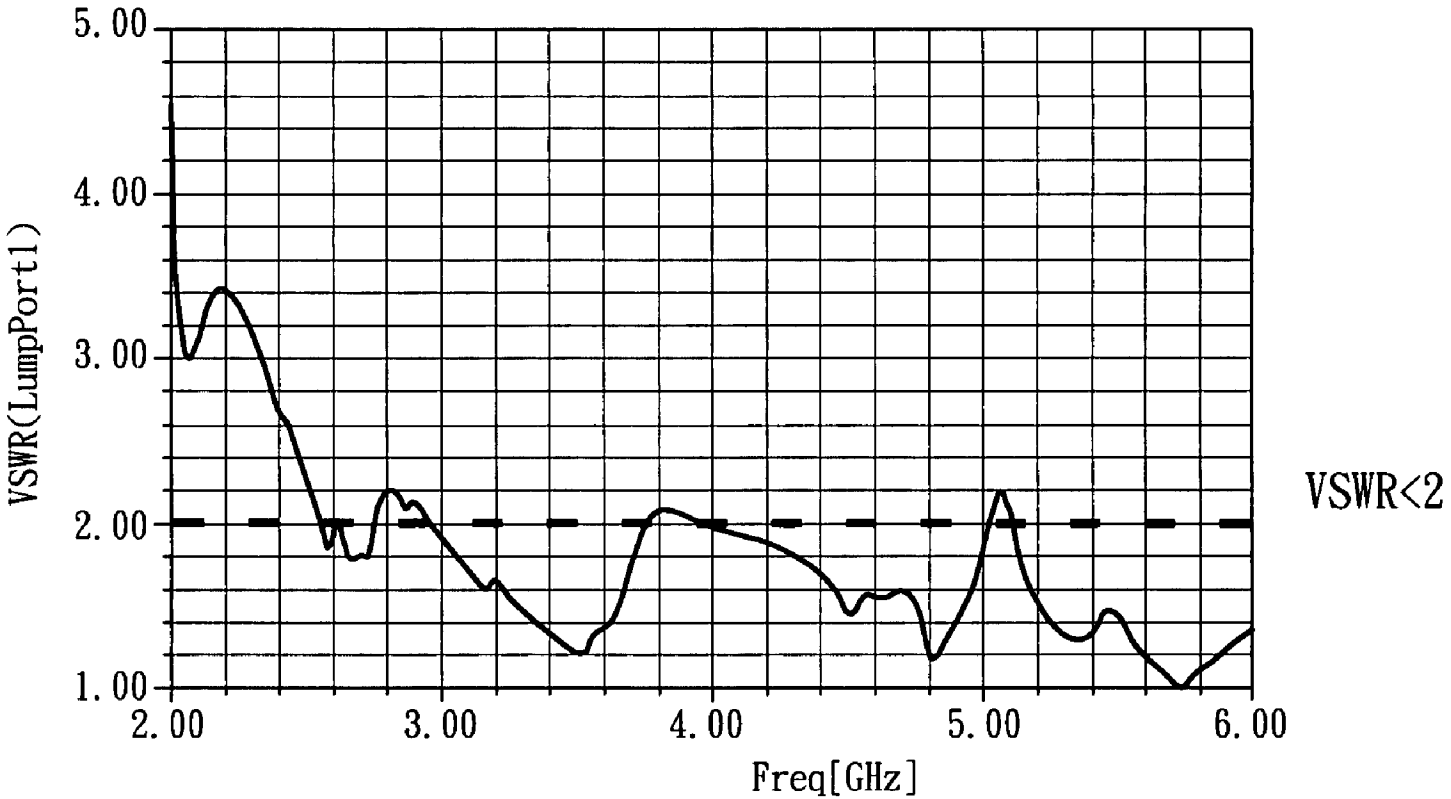
FIG. 7B shows the VSWR at different frequencies according to FIG. 7A.

Please refer to FIG. 7A. FIG. 7A is a perspective view of a broadband antenna according to a sixth embodiment of the present invention. A feeding plane 50*e* of a broadband antenna 10*f* has a tuning bar 53 which can be used as a radiating element close to the feeding point F to improve high frequency matching of the broadband antenna 10*f*. FIG. 7B shows the VSWR at different frequencies according to FIG. 7A. As shown in FIG. 7B, the broadband antenna 10*f* with the tuning bar 53 has a wider working frequency range at high frequencies.

Figure 8:
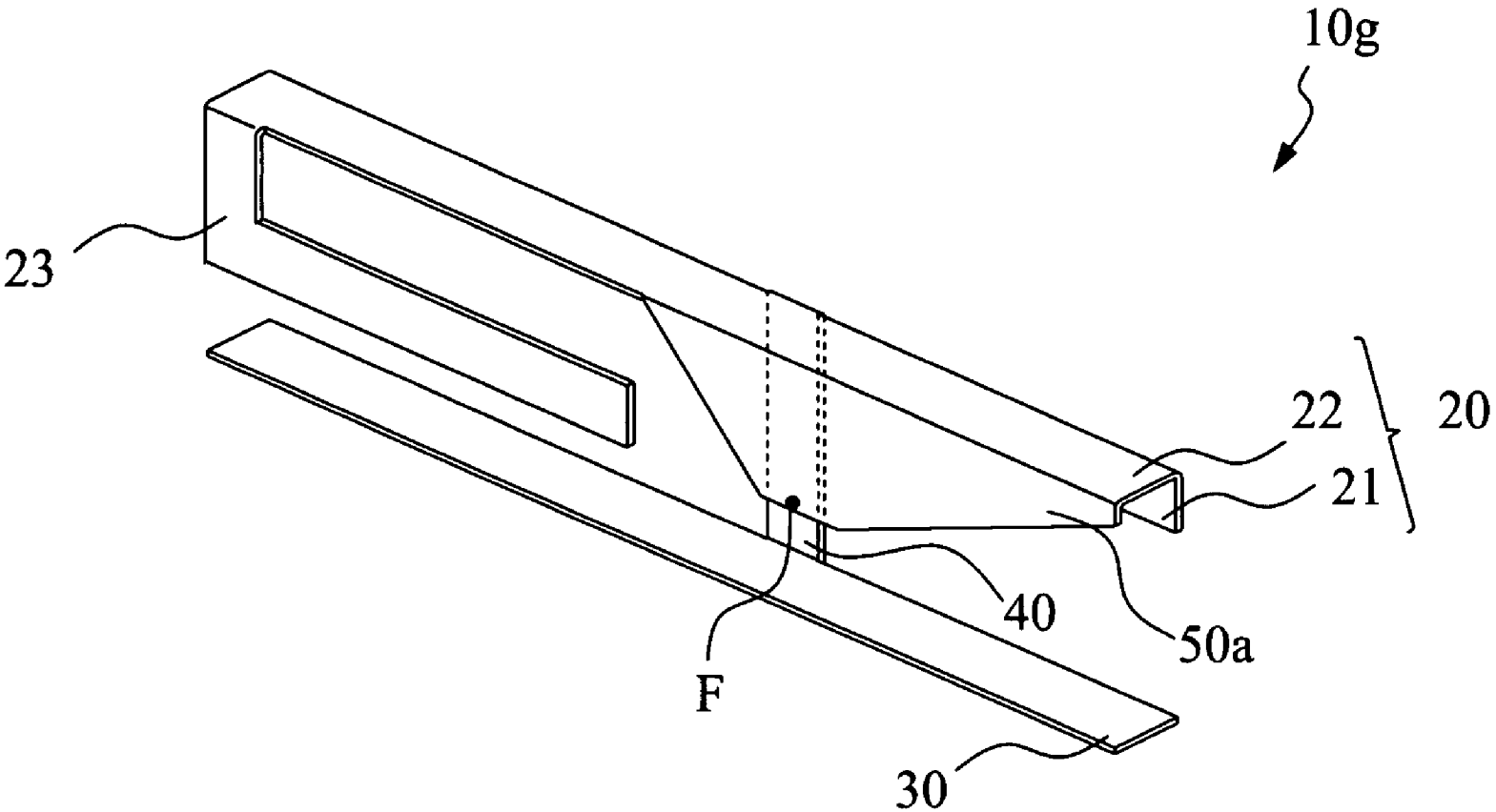
FIG. 8 is a perspective view of a broadband antenna according to a seventh embodiment of the present invention.

Please refer to FIG. 8. FIG. 8 is a perspective view of a broadband antenna according to a seventh embodiment of the present invention.

A broadband antenna 10*g* includes a high frequency shorted monopole antenna and a low frequency planar inverted-F antenna (PIFA). In contrast to the structures of the above-mentioned broadband antenna 10*a* and the broadband antenna 10*f*, the broadband antenna 10*g* has a third radiation area 23 next to the feeding plane 50*a*. The third radiation area 23 is formed by extending the second radiation area 22 of the radiating element 20. The third radiation area 23 is substantially perpendicularly connected to the second radiation area 22, and is used as a resonating low frequency structure. By adding the third radiation area 23, the broadband antenna 10*g* can have a lower working frequency bandwidth to fulfill requirements of other types of antennas, such as WWAN antennas that have a working frequency that is mainly under 2.3 GHz.

Figure 9A:
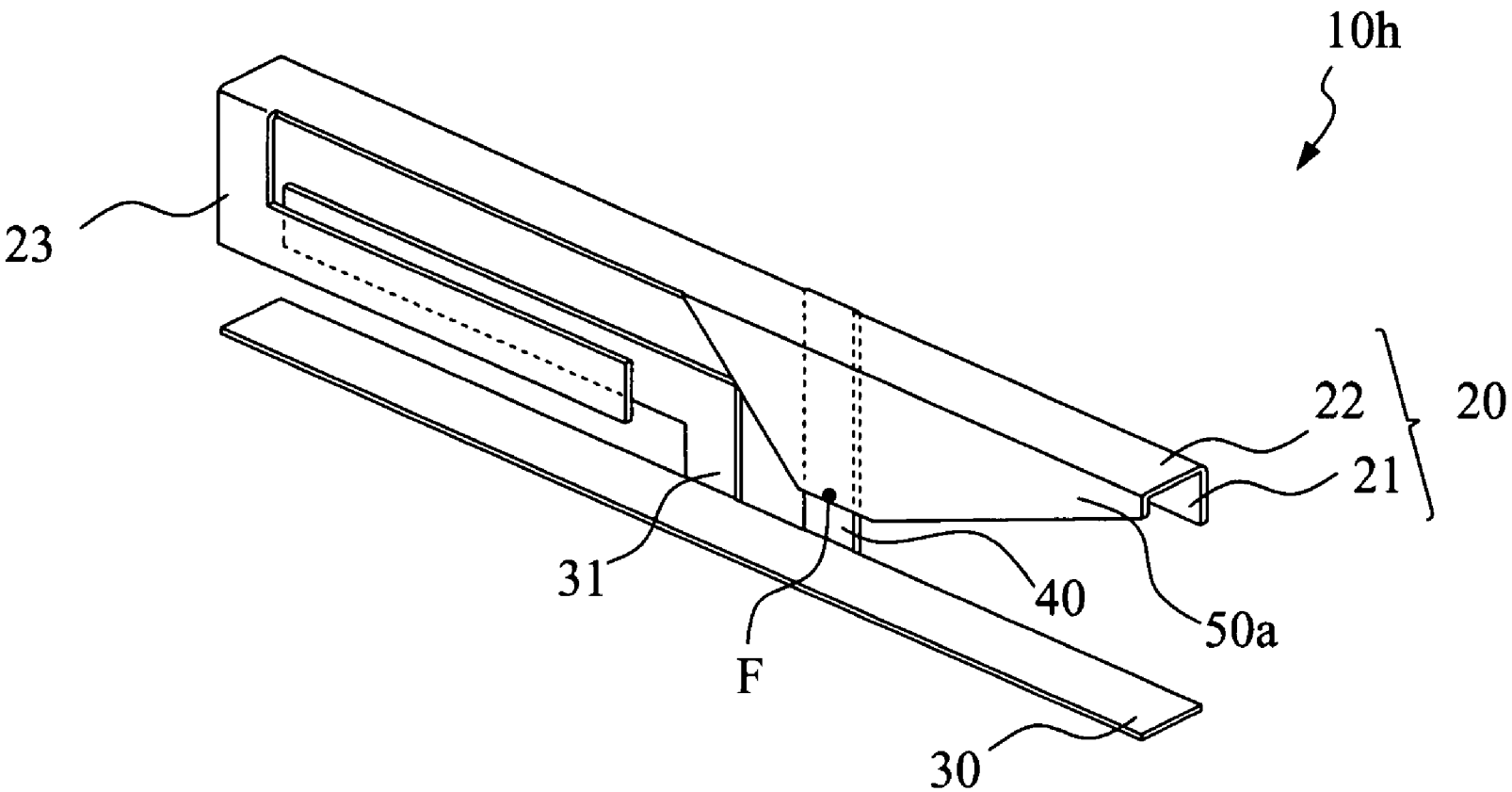
FIG. 9A is a perspective view of a broadband antenna according to an eighth embodiment of the present invention.
Figure 9B:
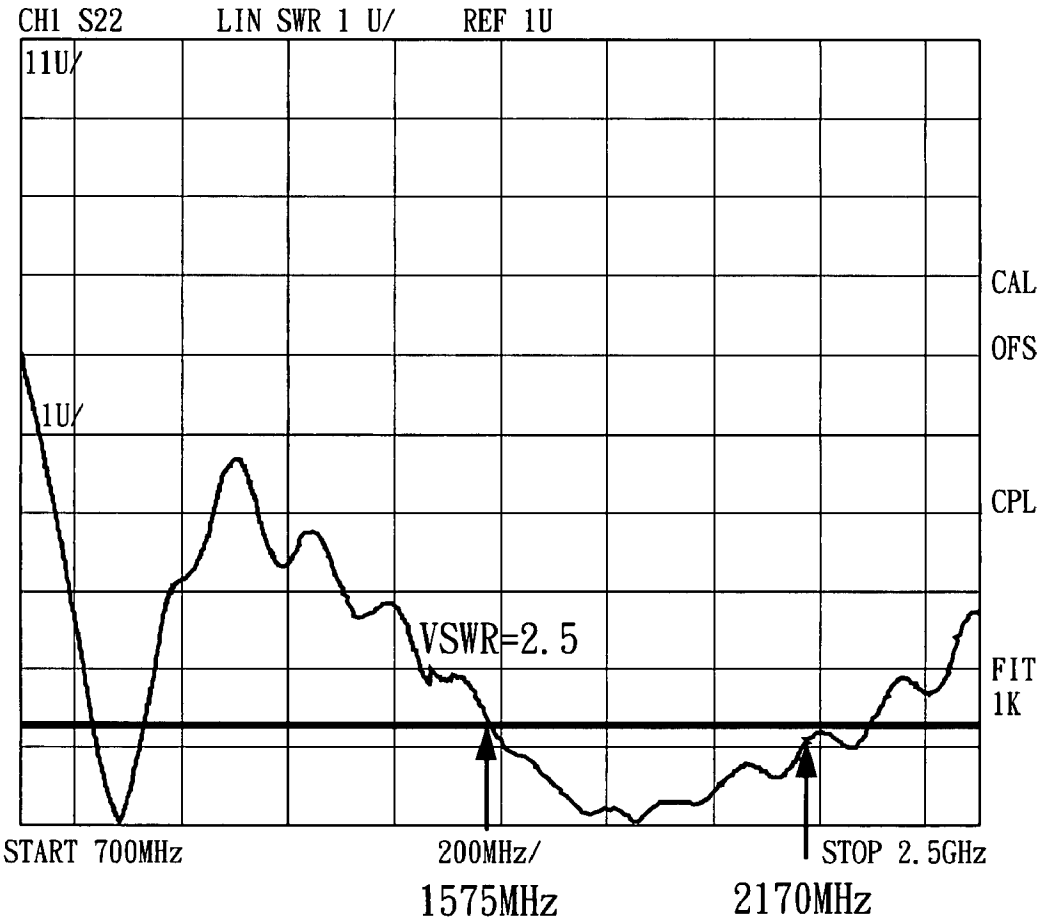
FIG. 9B shows the VSWR at different frequencies according to FIG. 9A.

Please refer to FIG. 9A. FIG. 9A is a perspective view of a broadband antenna according to an eighth embodiment of the present invention. In FIG. 9A, the grounding element 30 of a broadband antenna 10*h* is extended to formed a parasitic element 31 and is placed in a direction opposite to that of the third radiation area 23. The parasitic element 31 is used to lower the frequency bandwidth of the broadband antenna 10*h*. FIG. 9B shows the VSWR at different frequencies according to FIG. 9A. As shown in FIG. 9B, the broadband antenna 10*h* can operate from a frequency of about 1.6 GHz to 2.2 GHz, which can satisfy the bandwidth requirements of a WWAN antenna.

Figure 10:
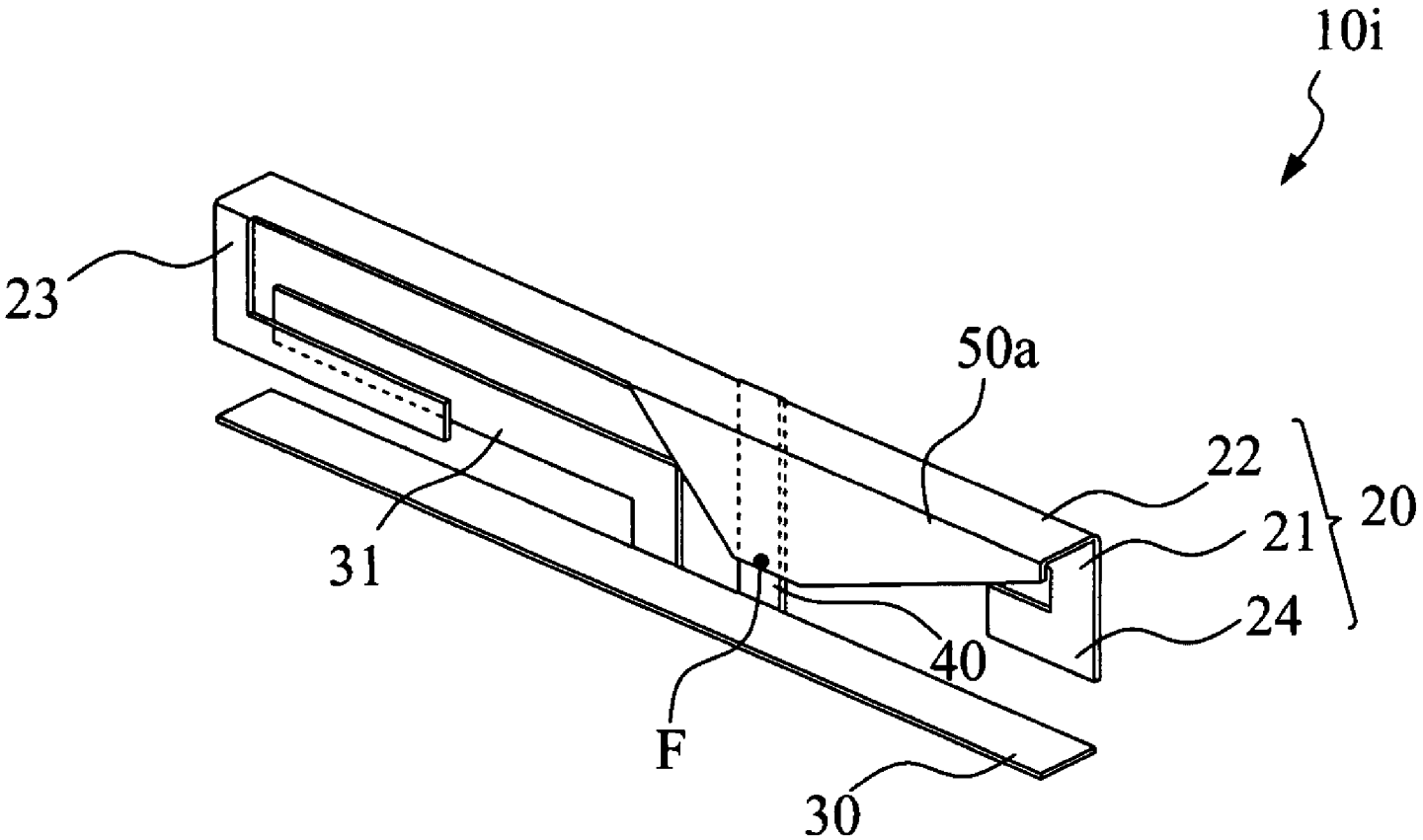
FIG. 10 is a perspective view of a broadband antenna according to a ninth embodiment of the present invention.

Please refer to FIG. 10. FIG. 10 is a perspective view of a broadband antenna according to a ninth embodiment of the present invention.

In the ninth embodiment, the radiating element 20 of the broadband antenna 10*i* is extended to form a fourth radiation area 24. The fourth radiation area 24 and the first radiation area 21 are connected together to increase the radiating abilities of the radiating element 20.

Figure 11A:
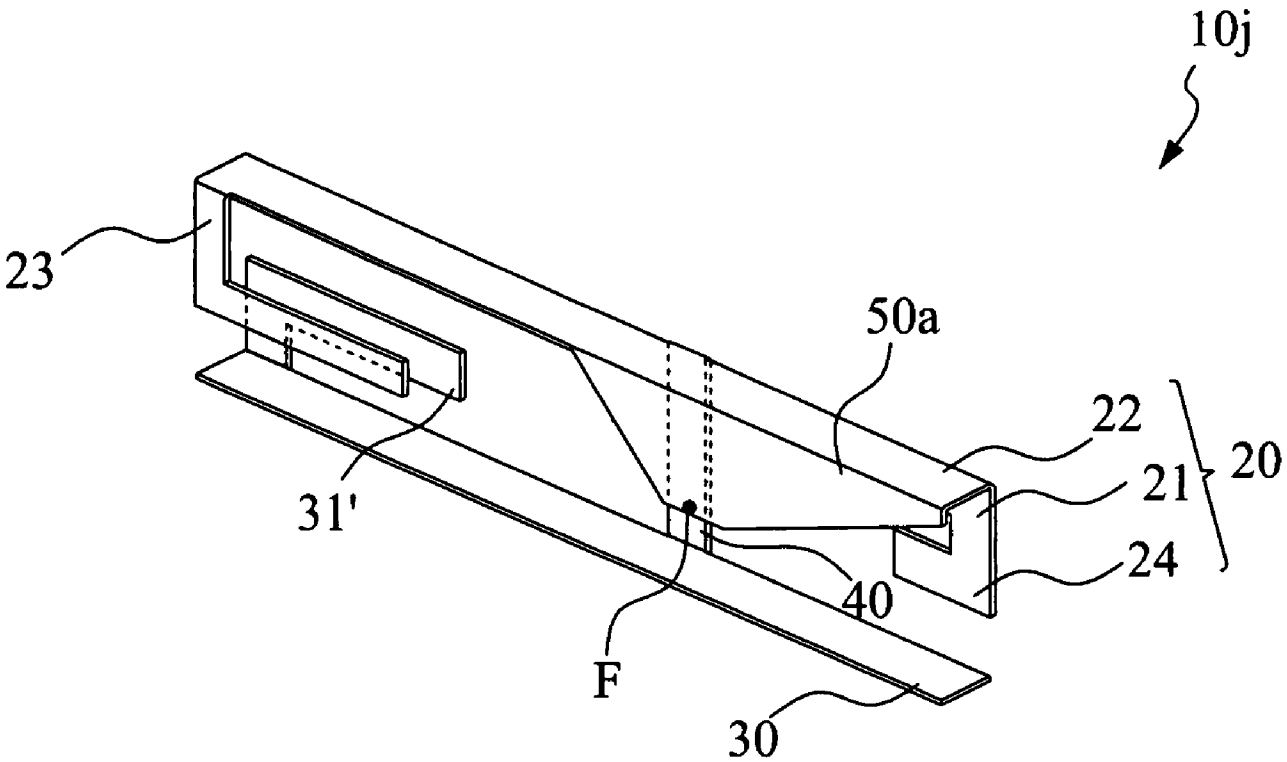
FIG. 11A is a perspective drawing of a broadband antenna according to a tenth embodiment of the present invention.

On the other hand, the parasitic element 31 can also be aligned in different directions. FIG. 11A is a perspective view of a broadband antenna according to a tenth embodiment of the present invention. As shown in FIG. 11A, a parasitic element 31' of a broadband antenna 10*j* and the parasitic element 31 of the broadband antenna 10*i* shown in FIG. 10 are oriented in different directions. The parasitic element 31' of the broadband antenna 10*j* is oriented in a direction that is in the same direction as the third radiation area 23.

Figure 11B:
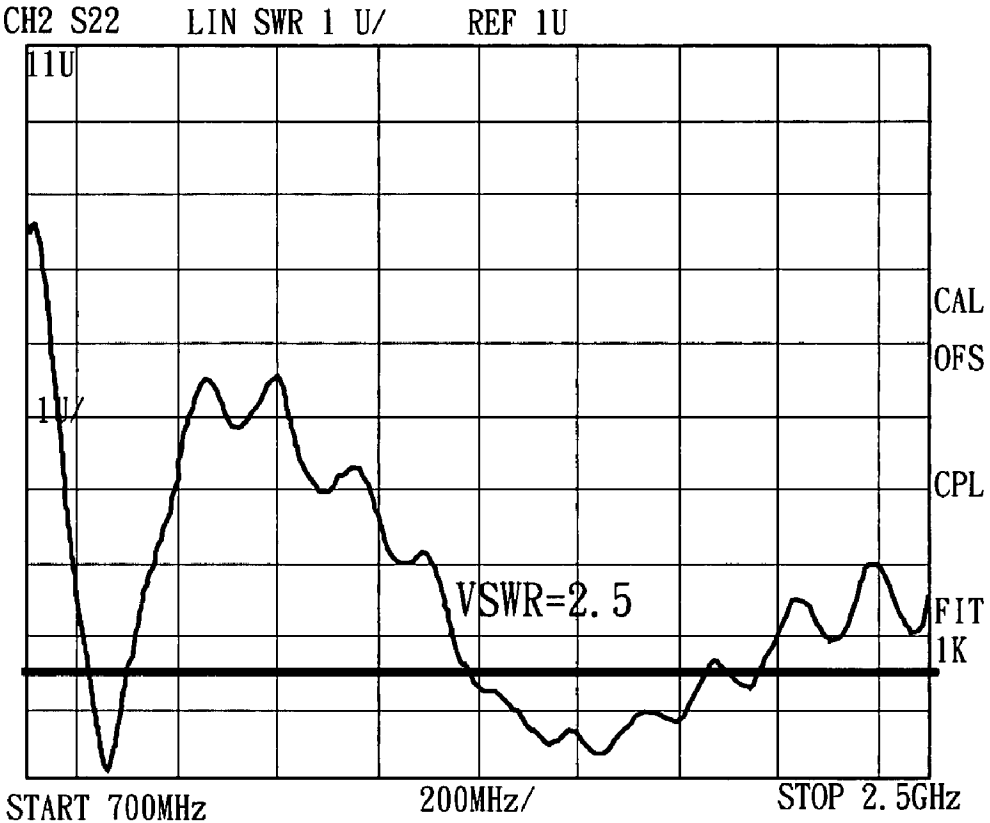
FIG. 11B shows the VSWR at different frequencies according to FIG. 11A.
Figure 11C:
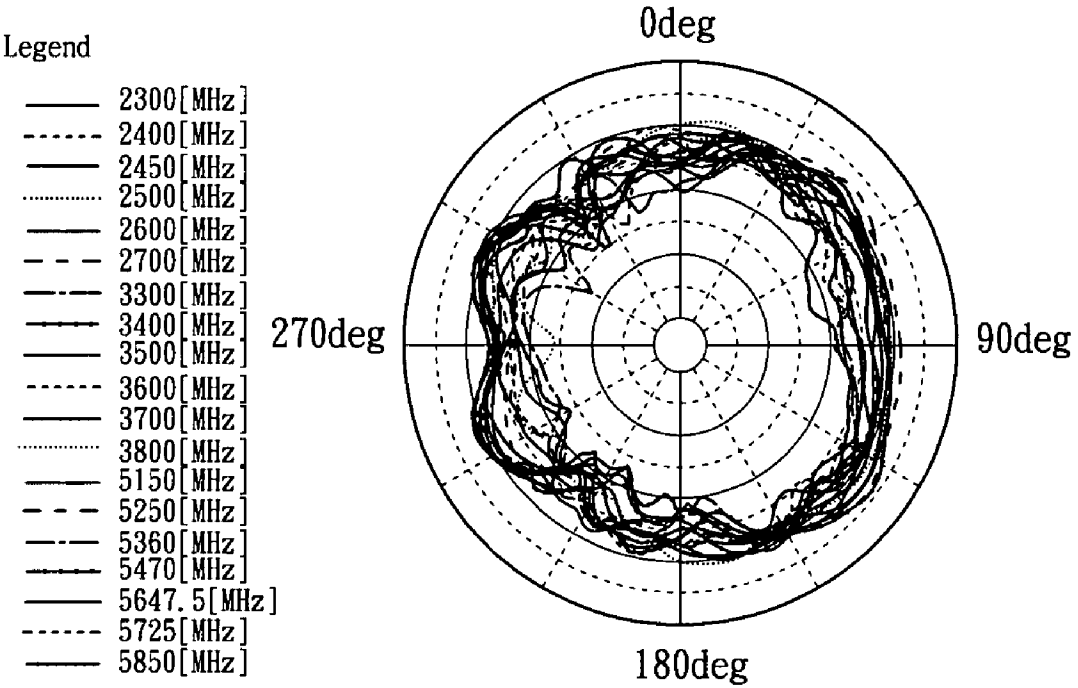
FIG. 11C shows a broadband antenna of FIG. 11A on a horizontal plane.

FIG. 11B shows the VSWR at different frequencies according to FIG. 11A. As shown in FIG. 11B, the broadband antenna 10*j* can operate at frequencies from around 1.6 GHz to 2.1 GHz. The broadband antenna 10*j* thus also satisfies the bandwidth requirements of a WWAN antenna. FIG. 11C shows a broadband antenna of FIG. 11A on a horizontal plane. As shown in FIG. 11C, the broadband antenna 10*j* is also an omni-directional antenna.

Figure 12A:
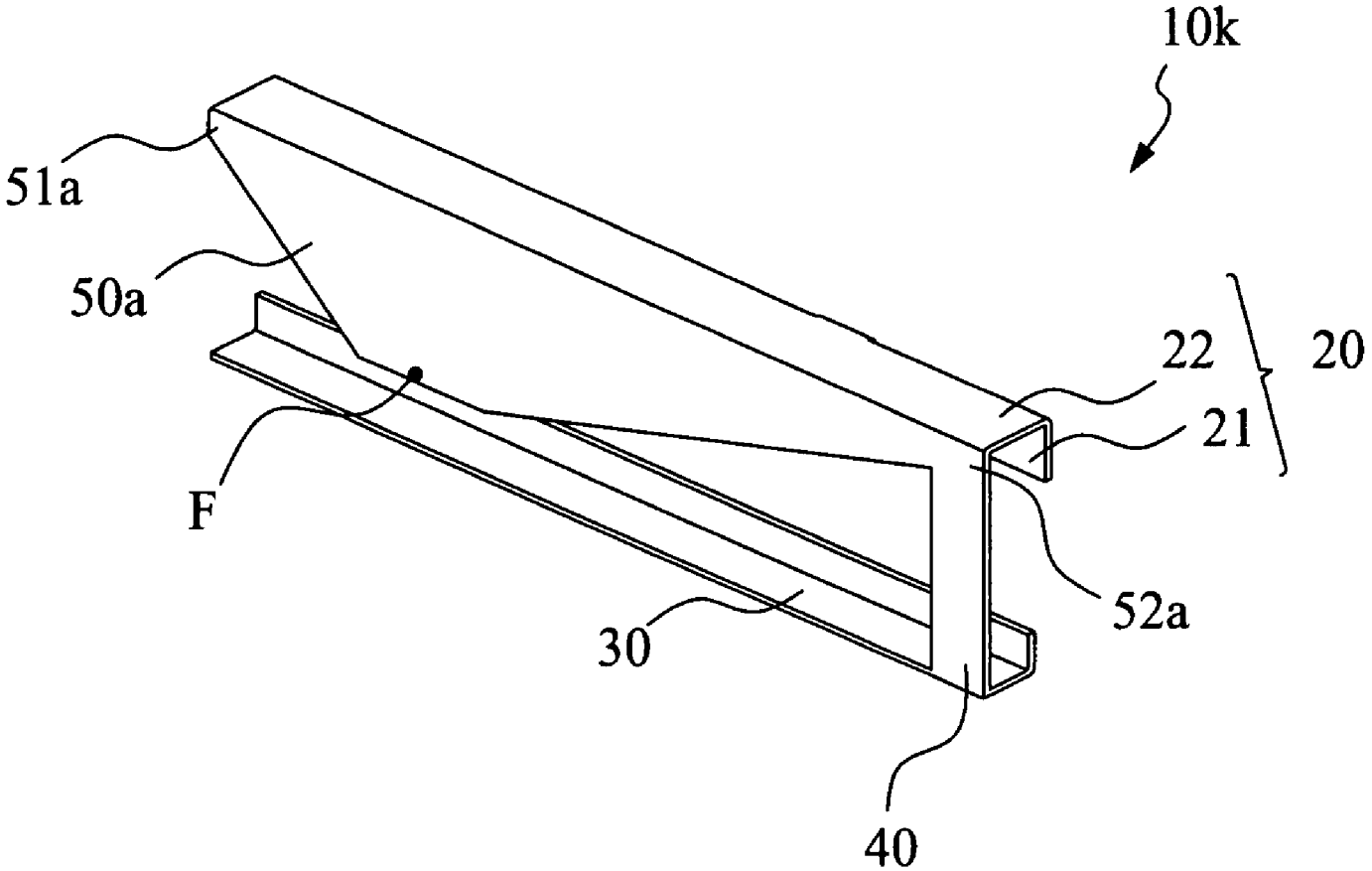
FIG. 12A is a perspective drawing of a broadband antenna according to an eleventh embodiment of the present invention.

Please refer to FIG. 12A. FIG. 12A is a perspective view of a broadband antenna according to an eleventh embodiment of the present invention.

In the eleventh embodiment, the short-circuiting element 40 of the broadband antenna 10*k* is connected to both the feeding plane 50*a* and the grounding element 30. The distance between the first end 51*a* and the feeding point F is less than the distance between the second end 52*a* and the feeding point F. Also, the distance between the second end 52*a* and the short-circuiting element 40 is less than the distance between the first end 51*a* and the short-circuiting element 40. The broadband antenna 10*k* is in this manner provided a broader high frequency bandwidth.

Figure 12B:
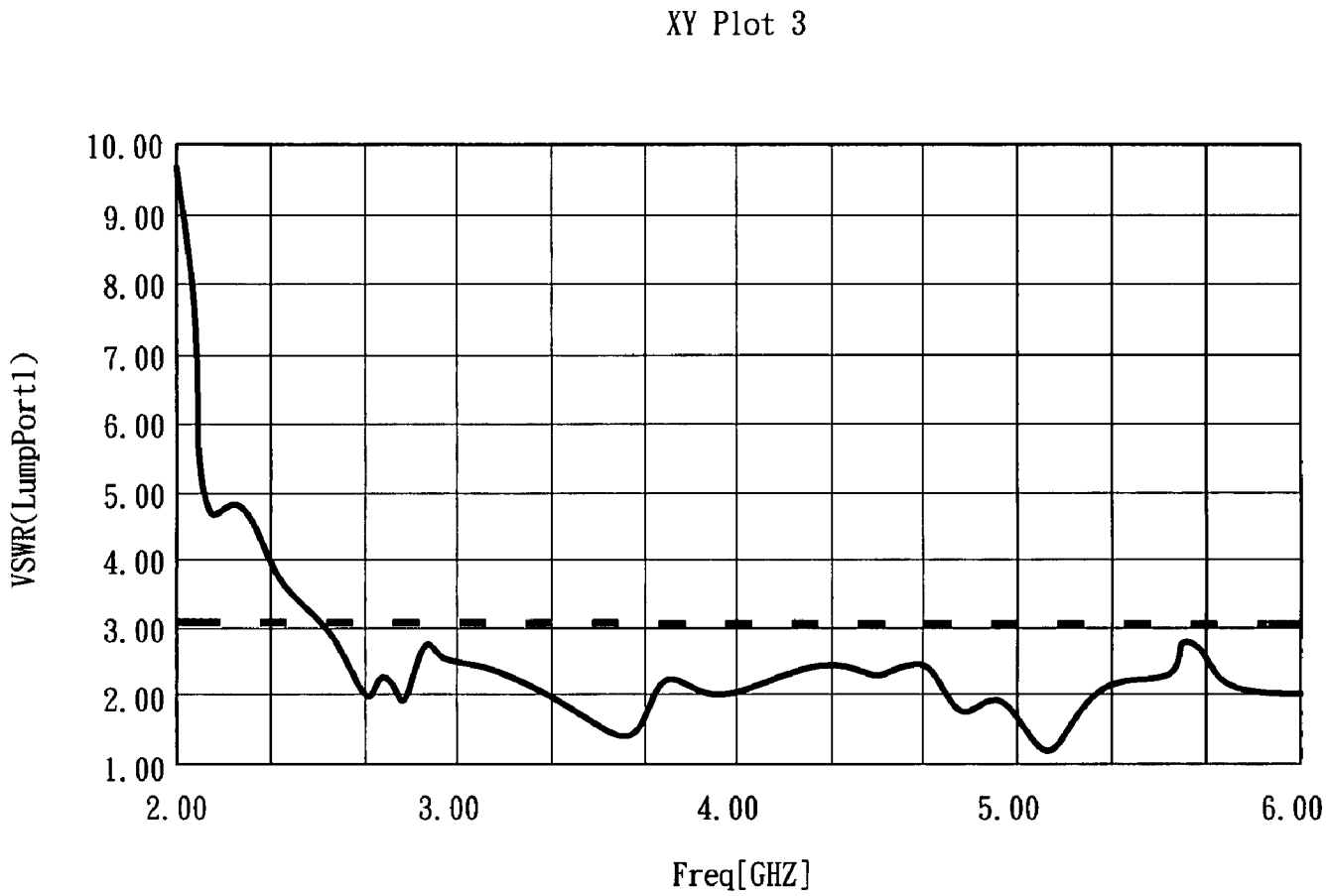
FIG. 12B shows the VSWR at different frequencies according to FIG. 12A.

FIG. 12B shows the VSWR at different frequencies according to FIG. 12A. As shown in FIG. 12B, from frequencies of 2.5 GHz to 6 GHz, the VSWR values of the broadband antenna 10*k* are all under 3. Therefore, the broadband antenna 10*k* is capable of transmitting signals with frequencies from 2.5 GHz to 5.9 GHz. In comparison with the prior art antenna 90 shown in FIG. 1A, the broadband antenna 10*k* has a broader bandwidth.

Figure 13A:
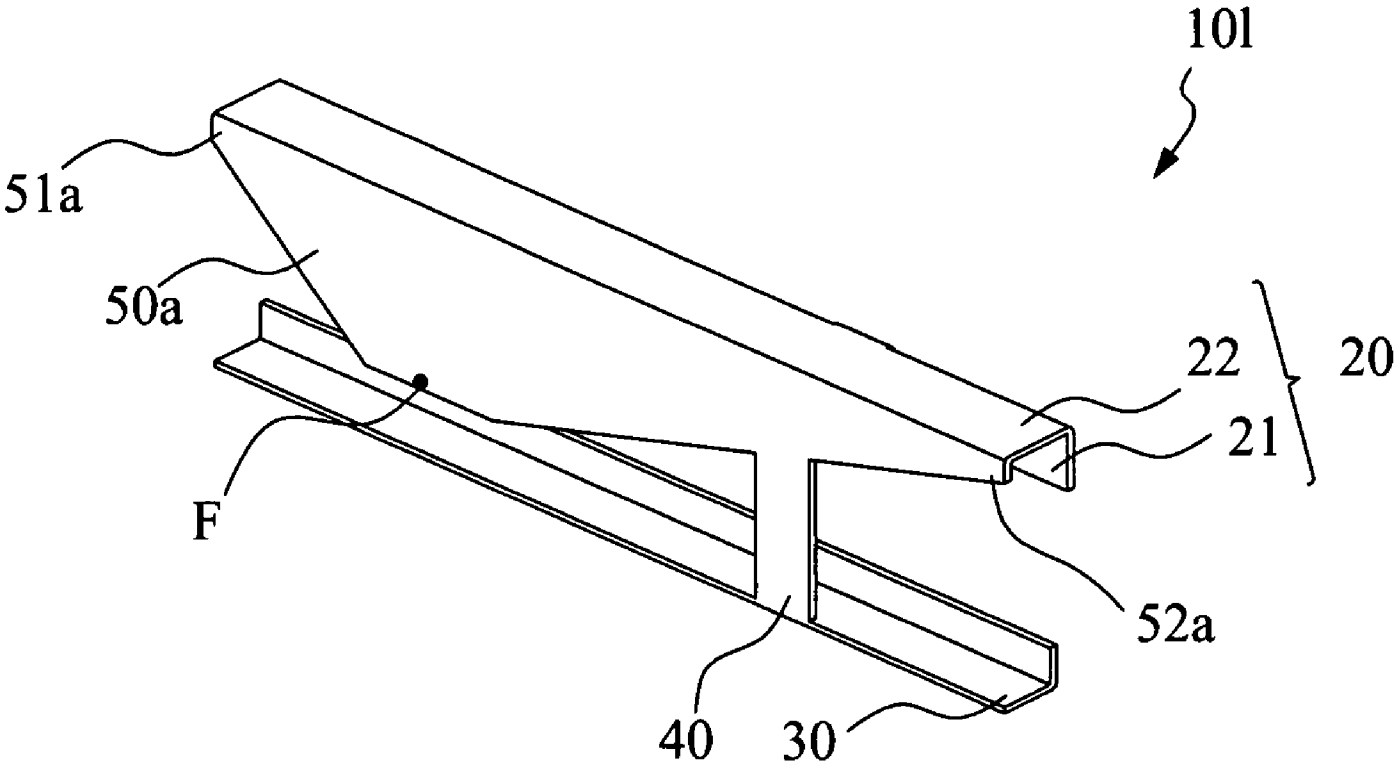
FIG. 13A is a perspective drawing of a broadband antenna according to a twelfth embodiment of the present invention.
Figure 13B:
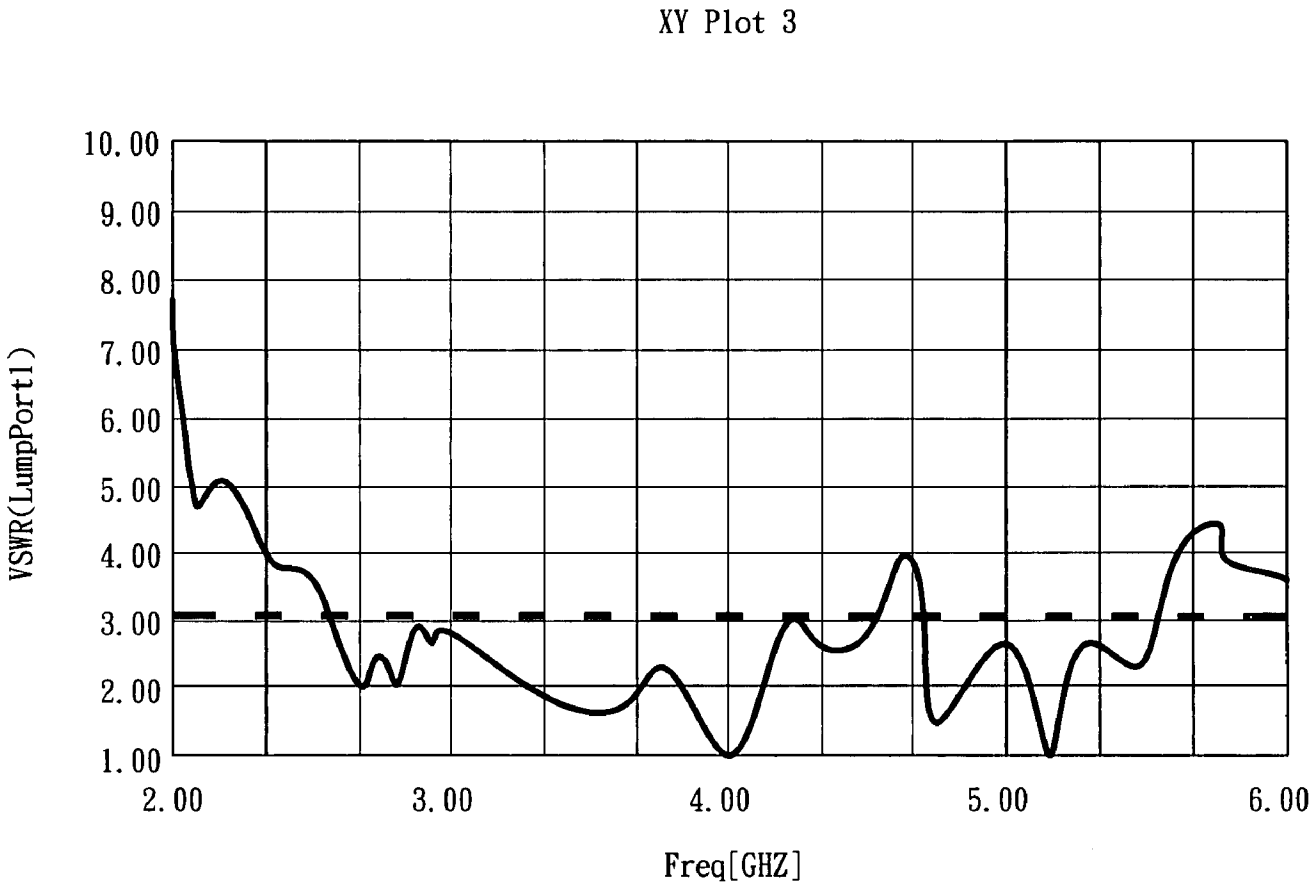
FIG. 13B shows the VSWR at different frequencies according to FIG. 13A.

Please refer to FIG. 13A and FIG. 13B. FIG. 13A is a perspective drawing of a broadband antenna according to a twelfth embodiment of the present invention. FIG. 13B shows the VSWR at different frequencies according to FIG. 13A.

As show in FIG. 13A, the short-circuiting element 40 of a broadband antenna 10*l* is located at a middle point between the second end 52*a* and the feeding point F substantially, meaning that the distance between the short-circuiting element 40 and the second end 52*a* is equal to the distance between the short-circuiting element 40 and feeding point F substantially. As show in FIG. 13B, the broadband antenna 10*l* is capable of transmitting signals with frequencies from 2.5 GHz to 4.3 GHz. In comparison with the prior art antenna 90 shown in FIG. 1A, the broadband antenna 10*l* has a broader bandwidth.

Figure 14:
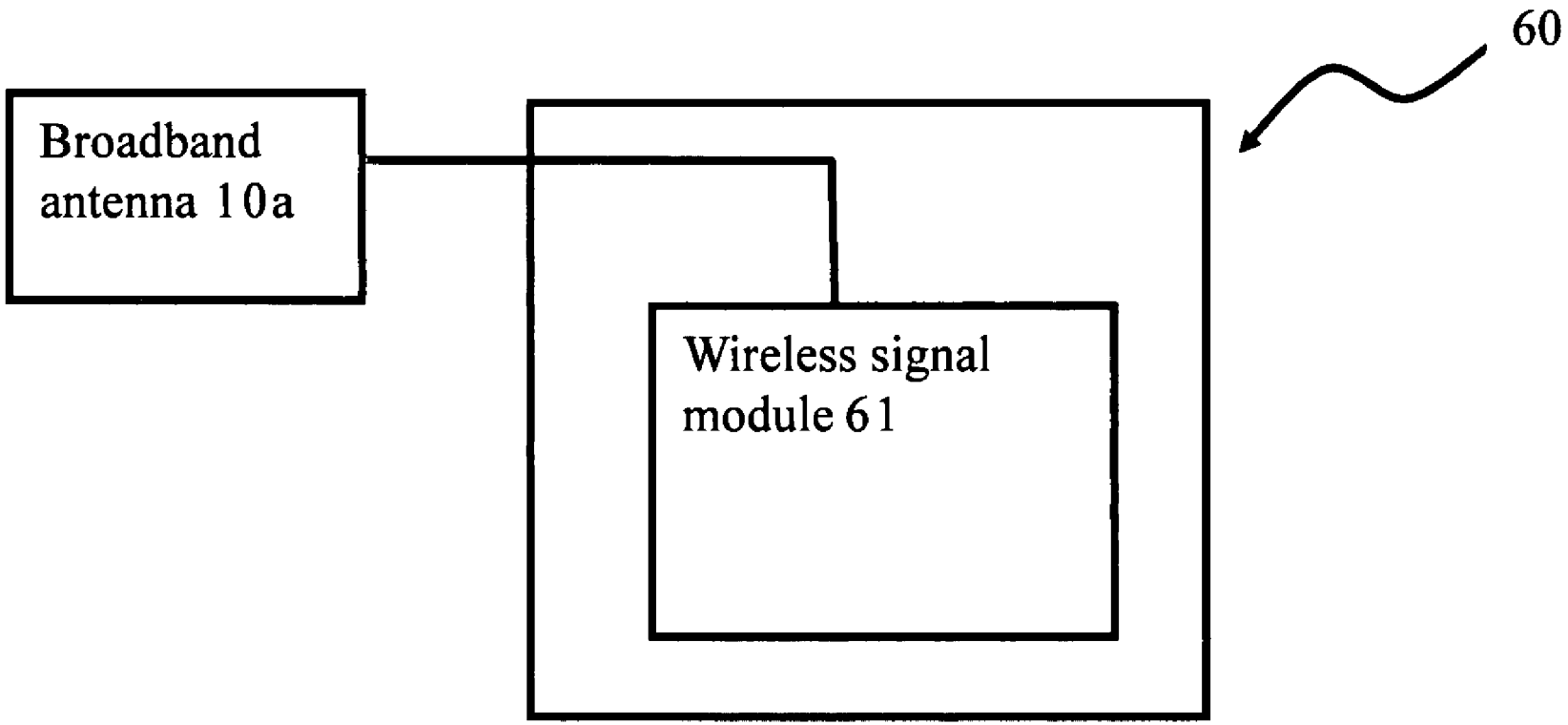
FIG. 14 is a functional block drawing of an electronic device of the present invention.

Please refer to FIG. 14. FIG. 14 is a functional block drawing of an electronic device of the present invention. An electronic device 60 can be a notebook computer, a GPS, or any other portable device. As shown in FIG. 14, the present invention uses RF cables to provide a feed to the broadband antenna 10*a* (or one of the broadband antennas 10*b* to 10*l*), and is connected to a wireless signal module 61 to use the wireless signal module 61 to process signals from the broadband antenna 10*a*, such as the transmitting or receiving of signals. The electronic device 60 can thus use the broadband antenna 10*a* to transmit or receive wireless signals from or to other devices (not shown).

Although the present invention has been explained in relation to its preferred embodiment, it is to be understood that many other possible modifications and variations can be made without departing from the spirit and scope of the invention as hereinafter claimed.

What is claimed is:

1. A broadband antenna comprising:

a radiating element having a first radiation area and a second radiation area, the first radiation area and the second radiation area perpendicularly connected to each other substantially;

a grounding element;

a feeding plane perpendicularly connected to the second radiation area substantially, the feeding plane comprising a feeding point, a first end and a second end; wherein a distance between the feeding point and the first end is less than a distance between the feeding point and the second end; and a short-circuiting element, used for connecting the first radiation area with the grounding element or connecting the feeding plane with the grounding element.

2. The broadband antenna as claimed in claim 1, wherein a distance between the short-circuiting element and the second end is less than a distance between the short-circuiting element and the first end, and a distance between the short-circuiting element and the second end is less than or equal to a distance between the short-circuiting element and the feeding point.

3. The broadband antenna as claimed in claim 2, wherein the feeding plane further comprises a tuning bar.

4. The broadband antenna as claimed in claim 2, wherein the feeding plane further comprises a substantially straight linear edge.

5. The broadband antenna as claimed in claim 2, wherein the feeding plane further comprises a substantially curved edge.

6. The broadband antenna as claimed in claim 1, wherein the feeding point further comprises a feeding line for transmitting electrical signals.

7. The broadband antenna as claimed in claim 1, wherein the second radiation area further comprises a third radiation area extended from the second radiation area.

8. The broadband antenna as claimed in claim 7, wherein the grounding element further comprises a parasitic element extended from the grounding element.

9. The broadband antenna as claimed in claim 8, wherein the parasitic element and the third radiation area are disposed oriented in the same direction or in opposite directions.

10. The broadband antenna as claimed in claim 7, wherein the radiating element further comprises a fourth radiation area, and the fourth radiation area is connected to the first radiation area.

11. An electronic device having a broadband antenna and capable of wireless transmissions comprising:

a wireless transmission module; and a broadband antenna electrically connected to the wireless transmission module, the broadband antenna comprising:

a radiating element having a first radiation area and a second radiation area, the first radiation area and the second radiation area perpendicularly connected to each other substantially;

a grounding element;

a feeding plane perpendicularly connected to the second radiation area substantially, the feeding plane comprising a feeding point, a first end and a second end; wherein a distance between the feeding point and the first end is less than a distance between the feeding point and the second end; and a short-circuiting element, used for connecting the first radiation area with the grounding element or connecting the feeding plane with the grounding element.

12. The electronic device having a broadband antenna as claimed in claim 11, wherein a distance between the short-circuiting element and the second end is less than a distance between the short-circuiting element and the first end, and a distance between the short-circuiting element and the second end is less than or equal to a distance between the short-circuiting element and the feeding point.

13. The electronic device having a broadband antenna as claimed in claim 12, wherein the feeding plane further comprises a tuning bar.

14. The electronic device having a broadband antenna as claimed in claim 12, wherein the feeding plane further comprises a substantially straight linear edge.

15. The electronic device having a broadband antenna as claimed in claim 12, wherein the feed plane further comprises a substantially curved edge.

16. The electronic device having a broadband antenna as claimed in claim 11, wherein the feeding point further comprises a feeding line for transmitting electrical signals.

17. The electronic device having a broadband antenna as claimed in claim 11, wherein the second radiation area further comprises a third radiation area extended from the second radiation area.

18. The electronic device having a broadband antenna as claimed in claim 17, wherein the grounding element further comprises a parasitic element extended from the grounding element.

19. The electronic device having a broadband antenna as claimed in claim 18, wherein the parasitic element and the third radiation area are disposed oriented in the same direction or in opposite directions.

20. The electronic device having a broadband antenna as claimed in claim 17, wherein the radiating element further comprises a fourth radiation area, and the fourth radiation area is connected to the first radiation area.

* * * * *